US010077627B2

(12) United States Patent
Craigon et al.

(10) Patent No.: US 10,077,627 B2
(45) Date of Patent: Sep. 18, 2018

(54) DOWNHOLE APPARATUS AND METHOD

(71) Applicant: Petrowell Limited, Aberdeen (GB)

(72) Inventors: Alan Craigon, Angus (GB); Stephen Reid, Aberdeen (GB); Philip C G Egleton, Newmachar (GB)

(73) Assignee: PETROWELL LIMITED, Aberdeen, Aberdeenshire (GB)

( * ) Notice: Subject to any disclaimer, the term of this patent is extended or adjusted under 35 U.S.C. 154(b) by 568 days.

(21) Appl. No.: 14/441,752

(22) PCT Filed: Nov. 7, 2013

(86) PCT No.: PCT/GB2013/052930
§ 371 (c)(1),
(2) Date: May 8, 2015

(87) PCT Pub. No.: WO2014/072724
PCT Pub. Date: May 15, 2014

(65) Prior Publication Data

US 2015/0285028 A1 Oct. 8, 2015

(30) Foreign Application Priority Data

Nov. 8, 2012 (GB) ..... 1220167.9

(51) Int. Cl.
*E21B 34/00* (2006.01)
*E21B 34/02* (2006.01)
(Continued)

(52) U.S. Cl.
CPC ..... *E21B 34/02* (2013.01); *E21B 23/04* (2013.01); *E21B 34/10* (2013.01); *E21B 34/103* (2013.01);
(Continued)

(58) Field of Classification Search
CPC combination set(s) only.
See application file for complete search history.

(56) References Cited

U.S. PATENT DOCUMENTS 5,984,014 A 11/1999 Poullard et al.
8,272,443 B2 1/2012 Watson et al.
(Continued)

FOREIGN PATENT DOCUMENTS

GB 2366579 A 8/2000
WO 99/47789 A1 9/1999
(Continued)

OTHER PUBLICATIONS

Office Action in counterpart Canadian Appl. 2890348, dated Dec. 22, 2016 3-pgs.
(Continued)

*Primary Examiner* — David L Andrews
*Assistant Examiner* — Ronald R Runyan
(74) *Attorney, Agent, or Firm* — Blank Rome, LLP

(57) ABSTRACT

An activation apparatus (10) for activating a downhole tool comprising a top sub (12), a bottom sub (14), an outer sleeve (16) having a port (18) and an inner sleeve (20) having a port (22). The apparatus (10) is configurable between a run-in configuration in which the ports (18, 22) are not aligned and an activated configuration in which the ports (18, 22) are aligned and permit lateral passage of fluid through the apparatus (10), the activation apparatus (10) being configured such that application of at least two forces to the activation apparatus (10) transitions the activation apparatus (10) from the run-in configuration to the activated configuration.

23 Claims, 32 Drawing Sheets

(51) Int. Cl.
*E21B 23/04* (2006.01)
*E21B 34/10* (2006.01)
*E21B 41/00* (2006.01)

(52) U.S. Cl.
CPC ..... *E21B 41/00* (2013.01); *E21B 2034/007* (2013.01)

(56) References Cited

U.S. PATENT DOCUMENTS

| | | | | |
|---|---|---|---|---|
| 8,267,178 | B1 | 9/2012 | Sommers et al. | |
| 8,757,273 | B2 | 6/2014 | Themig et al. | |
| 2011/0100643 | A1* | 5/2011 | Themig ..... | E21B 34/102 166/373 |
| 2011/0108272 | A1 | 5/2011 | Watson et al. | |
| 2013/0068475 | A1 | 3/2013 | Hofman et al. | |
| 2013/0025872 | A1 | 10/2013 | Mailand | |

FOREIGN PATENT DOCUMENTS

| | | |
|---|---|---|
| WO | 2011072367 | 6/2011 |
| WO | 2013033659 A1 | 3/2013 |
| WO | 2013033661 A1 | 3/2013 |

OTHER PUBLICATIONS

International Search Report and Written Opinion received in corresponding application No. PCT/GB2013/052930 dated Oct. 29, 2014, 5 pages.
Search Report in counterpart UK Appl. GB1220167.9, dated Feb. 7, 2014, 4-pgs.

* cited by examiner

DOWNHOLE APPARATUS AND METHOD

FIELD OF THE INVENTION

This invention relates to a downhole apparatus and method. More particularly, but not exclusively, embodiments of the invention relate to an activation apparatus and method for activating a downhole tool.

BACKGROUND TO THE INVENTION

In the oil and gas exploration and production industry, well boreholes are drilled in order to access subsurface hydrocarbon-bearing formations. The drilled borehole may then be lined with sections of bore-lining tubing, such as casing or liner. In some instances, each section of bore-lining tubing may be provided with threaded connectors, or otherwise joined, to form a string, such as a completion string, which is run into the borehole and operable to perform a number of different operations in the borehole. One operation which may be carried out in the borehole is hydraulic fracturing, commonly known as "fracking", which involves the injection of fluid into the formation to propagate fractures in the formation rock and increase flow of hydrocarbons into the borehole for extraction. In use, one or more fracturing tools may be run into the borehole with the completion string and located adjacent to the formation. Fluid may then be directed through ports in a sidewall of the fracturing tool and injected into the formation. In some instances, a number of fracturing tools may be located at different axially spaced positions in the completion string and configured to facilitate fracturing of multiple and/or selected formations.

Completion strings are becoming ever more complex, with the various completion string tools utilising a variety of activation mechanisms, forces and pressures. Also, completion strings may in many instances be run in non-vertical, horizontal or deviated boreholes in which the distal end, or toe, of the borehole may be a significant lateral distance away from the wellhead.

The increased complexity of completion strings, and the complex geometry and topography of some boreholes may present a number of problems.

For example, in deviated or horizontal boreholes the ability to apply and control application of mechanical forces to a given tool of the completion string, such as to activate and/or deactivate the tool, may be limited. Where it is desired to apply a push or pull force to activate a tool of the completion string, for example, it will be recognised that for horizontal or deviated boreholes the vertical proportion of the completion string to which the push or pull force is applied may be relatively small. As a result, accurate control of the greater proportion of the completion string disposed in the non-vertical section of the borehole is limited.

Fluid pressure activation arrangements may permit tools to be controlled over distance and in both vertical and non-vertical borehole sections. However, there is a risk that a given tool may activate prematurely in complex completion strings having a number of fluid pressure activated tools operable at a variety of activation pressures. In some instances, such premature activation may reduce the efficiency of hydrocarbon extraction from the borehole. However, in other instances premature activation of a tool may require the completion string to be removed, where this is possible, a workover operation to be carried out, or may even result in the borehole being abandoned, at significant time and expense to the operator.

SUMMARY OF THE INVENTION

According to a first aspect of the present invention there is provided an activation apparatus for activating a downhole tool, the activation apparatus being configured such that application of at least two forces to the activation apparatus transitions the activation apparatus from a first configuration to a second configuration.

According to a second aspect of the present invention there is provided a downhole tool and an activation apparatus, the activation apparatus being configured such that application of at least two forces to the activation apparatus transitions the activation apparatus from a first configuration to a second configuration.

Embodiments of the present invention may provide a number of benefits. For example, embodiments of the invention may prevent or at least mitigate the risk of premature activation of a downhole tool caused by inadvertent application of a force or pressure sufficient to cause activation of the tool. Alternatively or additionally, embodiments of the present invention may permit an operation to be carried out which involves application of a force sufficient to cause activation of the tool. By way of example, the operation may involve a downhole pressure test, embodiments of the invention permitting application of a test pressure up to or exceeding a pressure sufficient to cause activation of a downhole tool, for example one or more downhole tool operatively associated with the activation apparatus or another downhole tool. This is particularly beneficial as it permits testing to be carried out at full operational pressure or indeed higher than operational pressure in instances where previously this could not be achieved or would not be performed due to the risk of premature activation.

The activation apparatus may be configured to transition from the first configuration to the second configuration in a plurality of stages. In particular embodiments, the activation apparatus may be configured to transition from the first configuration to the second configuration in two stages. In other embodiments, the activation apparatus may be configured to transition from the first configuration to the second configuration in three or more stages.

The activation apparatus may further comprise a third configuration, the third configuration comprising a primed or intermediate configuration for example. The activation apparatus may be configured to transition from the first configuration to the primed configuration by application of, or following application of, a first of the at least two forces. In use, the activation apparatus may be configured such that application of a first of the at least two forces does not transition the activation apparatus from the first configuration to the second configuration, the activation apparatus transitioning to the second configuration by application of, or following application of, a second or subsequent force. Beneficially, this permits an operator to pressure up for test purposes above a setting pressure and reliably control this operation.

It will be recognised that where the activation apparatus is configured to transition from the first configuration to the second configuration in (n) stages, the activation apparatus may comprise (n−1) primed or intermediate configurations.

The activation apparatus may comprise a mechanical activation apparatus or activation mechanism. The first configuration may be mechanically different from the second configuration. The third configuration may be mechanically different from the first configuration and the second configuration. Beneficially, the provision of a mechanical activation apparatus may provide for reliable transition between the configurations of the activation apparatus, as may be required in a downhole environment.

The at least two forces may be of any suitable magnitude. In particular embodiments, at least two of the forces may be of the same magnitude. In other embodiments, at least two of the forces may be of different magnitude. The at least two forces may comprise at least a first force and a discrete second force. At least one of the forces may comprise a linear force. The at least two forces may be applied by a force application arrangement. The force application arrangement may be of any suitable form and construction.

The force application arrangement may comprise a mechanical force applicator. The mechanical force applicator may be of any suitable form and construction. The mechanical force applicator may comprise a resilient member or biasing member. The resilient member or biasing member may be of any suitable form and construction. The biasing member may comprise a spring, in particular embodiments a flat wire compression spring, Smalley wave spring or the like.

In some embodiments, the force application arrangement may comprise a single mechanical force applicator. In such embodiments, the at least two forces may be applied by the mechanical force applicator. In other embodiments, the force application arrangement may comprise a plurality of mechanical force applicators. At least two of the forces may be applied by a different mechanical force applicator. At least two of the forces may be applied by the same mechanical force applicator.

Alternatively or additionally, the force application arrangement may comprise a fluid pressure arrangement. The force application arrangement may comprise an applied fluid pressure. The applied fluid pressure may be applied from surface, for example but not exclusively via an axial fluid passage or conduit. Alternatively, or additionally, the force application arrangement may comprise a differential pressure acting on the activation apparatus.

The activation apparatus may be of any suitable form and construction.

The activation apparatus may comprise a first activation member. The first activation member may be of any suitable form and construction. The first activation member may comprise a resilient member. The first activation member may be configured to define a first, larger dimension, configuration and at least one smaller dimension configuration. The first activation member may comprise an outer activation member. The first activation member may comprise an annular member. The first activation member may an outer surface, an inner surface, an upper end face and a lower end face. In particular embodiments, the first activation member may comprise an outer snap ring.

The activation apparatus may comprise a second activation member. The second activation member may be of any suitable form and construction. The second activation member may comprise an inner activation member. The second activation member may comprise an annular member. The second activation member may comprise an upper section and a lower section. The upper section may comprise an inner surface, an outer surface and an end face. The lower section may comprise an inner surface, an outer surface and an end face. An inner shoulder may define the interface between the upper section inner surface and the lower section inner surface. An outer shoulder may define the interface between the upper section outer surface and the lower section outer surface. In particular embodiments, the second activation member may comprise an inner snap ring.

The activation apparatus may comprise a first stage retainer. The first stage retainer may be of any suitable form and construction. The first stage retainer may comprise at least one shear pin or the like.

The activation apparatus may comprise a second stage retainer. The second stage retainer may be of any suitable form and construction. The second stage retainer may comprise at least one shear pin or the like.

The activation apparatus may be configured to be locked in the first configuration.

The activation apparatus may be configured to be locked in the primed configuration.

Any suitable lock may be provided. The activation apparatus may be formed or arranged to provide the lock arrangement. For example, at least one of the first activation member and the second activation member may be configured to form, of form part of, the lock. Alternatively or additionally, at least one of the first stage retainer and the second stage retainer may form, or form part of, the lock. Alternatively or additionally, the downhole tool may be configured to form, or form part of, the lock.

At least two initiation forces may configure the activation apparatus to permit transitioning by the at least two forces.

The at least two initiation forces may be of any suitable magnitude. In particular embodiments, at least two of the initiation forces may comprise forces of different magnitude. In other embodiments, at least two of the initiation forces may comprise forces of the same magnitude. The at least two initiation forces may comprise at least a first stage initiation force and a second stage initiation force. At least one of the initiation forces may comprise a linear force.

The at least two initiation forces may comprise lock release forces. In use, the lock may be unlocked or otherwise released by the initiation forces to permit transitioning of the activation apparatus.

The at least two initiation forces may be applied by an initiation force application arrangement. The initiation force application arrangement may be of any suitable form and construction.

In particular embodiments, the initiation force application arrangement may comprise a fluid pressure arrangement. For example, the initiation force application arrangement may comprise an applied fluid pressure. The applied fluid pressure may be applied from surface, for example but not exclusively via an axial fluid passage or conduit, in particular embodiments an axial throughbore of the downhole tool. Alternatively or additionally, the force application arrangement may be applied downhole or via a differential pressure.

The applied fluid pressure may be of any suitable magnitude. The applied fluid pressure may be in the range of 5000 psi to 18000 psi. The applied fluid pressure may be in the range of 5000 psi to 15000 psi. The applied fluid pressure may be in the range of 9000 psi to 12000 psi. The applied fluid pressure may be in the range of 10000 psi to 18000 psi. In particular embodiments, a first of the at least two initiation forces may result from a first applied pressure and a second of the at least two initiation forces may result from a second applied pressure. In particular embodiments, the first pressure may be of greater magnitude than the second pressure. The first applied pressure may be in the range 10000 psi to 18000 psi, for example. The second applied pressure may be in the range 5000 to 15000 psi, for example. However, it will be recognised that the first applied pressure need not necessarily be higher than the second applied pressure. In other embodiments, the second pressure may be of the same or greater magnitude than the first pressure.

Alternatively or additionally, the initiation force application arrangement may comprise at least one mechanical initiation force applicator. The mechanically applied initiation force may be applied from surface. Alternatively, or additionally, the mechanically applied initiation force may be applied downhole, for example but not exclusively by a setting tool, shifting tool or the like.

At least one of the initiation forces may comprise a force equal to or exceeding a force at which a downhole tool is activated.

The at least two initiation forces may be distinct. For example, application of a first of the at least two initiation forces may be applied and then released or reduced prior to application of a second or subsequent of the at least two initiation forces.

A controller may control the application of either or both of the at least two forces and the at least two initiation forces to control transitioning of the activation apparatus.

The first configuration may comprise a run-in configuration. In use, the activation apparatus may be run into a borehole, for example an oil or gas well borehole, in the first configuration.

The second configuration may comprise an activation configuration. In use, the activation apparatus in the second configuration may activate or permit activation of one or more downhole tool.

In some embodiments, the activation apparatus may be integral to, of form part of, the downhole tool.

In other embodiments, the activation apparatus may be separate from the downhole tool. For example, the activation apparatus may be provided on an activation apparatus module, sub assembly or sub coupled to the downhole tool.

The downhole tool may be of any suitable form and construction.

The downhole tool may comprise a sleeve, such as a sliding sleeve device.

The downhole tool may comprise a toe sleeve or the like.

The downhole tool may be configured to permit circulation at the lower end of a borehole. For example, the downhole tool may in use act as a sacrificial zone to permit fluid flow in a ball drop fracture completion string, where it is desired to flow a ball downhole.

The downhole tool may comprise a flow control device. The downhole tool may comprise an inflow control device (ICD) or the like.

The downhole tool may comprise an axial flow passage. For example the downhole may comprise an axial throughbore.

The downhole tool may comprise a lateral flow passage.

In the first configuration, the downhole tool may be configured to prevent lateral passage of fluid through the downhole tool.

In the primed configuration, the downhole tool may be configured to prevent lateral passage of fluid through the downhole tool.

In the second configuration, the downhole tool may be configured to permit lateral passage of fluid through the downhole tool.

The tool may comprise a first member.

The first member may be of any suitable form and construction. The first member may be tubular. The first member may comprise a sleeve. The first member may comprise an inner sleeve. In use, the at least two forces may act on the first member to permit transitioning of the activation apparatus.

The first member may comprise a single component. In particular embodiments, however, the first member may comprise a plurality of components. For example, the first member may comprise two or more of an uphole section, a mid-section and a downhole section. In particular embodiments, but not exclusively, the first member flow passage may be provided in the mid-section.

The first member uphole section may be of any suitable form and construction. In particular embodiments, the first member uphole section may comprise an upper section and a lower section. The upper section may comprise an inner surface, an outer surface and at least one end face. At least one of end faces may be disposed on a flange portion. The lower section may comprise an inner surface, an outer surface and an end face. The lower section may be recessed relative to the upper section. An inner shoulder may form the interface between the upper section inner surface and the outer section inner surface. An outer shoulder may form the interface between the upper section outer surface and the lower surface outer surface. A groove may be formed or otherwise provided in the uphole section outer surface. A seal element may be disposed in the groove. The seal element may be of any suitable form and construction. In particular embodiments, the seal element may comprise an o-ring seal or the like. In particular embodiments, the seal element may be provided with one or more seal back-up elements.

The first member mid-section may be of any suitable form and construction.

The first member mid-section may comprise an upper section and a lower section. The upper section may comprise an inner surface, an outer surface and an end face. The lower section may comprise an inner surface and an outer surface and an end face. The outer surface may comprise a stepped outer surface. An inner shoulder may form the interface between the upper section inner surface and lower section inner surface. An outer shoulder may form the interface between the upper section outer surface and the lower section outer surface. In embodiments where the outer surface comprises a stepped outer surface, a plurality of outer shoulders may form the interfaces between the steps. A groove may be formed or otherwise provided in the mid-section inner surface. A seal element may be disposed in the groove. The seal element may be of any suitable form and construction. In particular embodiments, the seal element may comprise an o-ring seal or the like. In particular embodiments, the seal element may be provided with one or more seal back-up elements. A groove, and in particular embodiments, a plurality of grooves, may be formed or otherwise provided in the outer surface. A seal element may be disposed in the, or each, groove. The, or each, seal element may be of any suitable form and construction. In particular embodiments, the, or each, seal element may comprise an o-ring seal or the like. In particular embodiments, the, or each, seal element may be provided with one or more seal back-up elements.

The first member downhole section may be of any suitable form and construction. The downhole section may comprise an outer surface, an inner surface and end faces. The inner surface may comprise a stepped inner surface.

The first member uphole section, mid-section and downhole section may be arranged in any suitable arrangement. The first member uphole section and the first member mid-section may be overlapped. For example, the upper section of mid-section may be disposed around the lower section of the uphole section.

The first member mid-section and the first member downhole section may be overlapped. For example, the downhole section may be disposed around the lower section of mid-section.

Two of more of the first member uphole section, mid-section and downhole section may be coupled together. The first member uphole section and the first member mid-section may be coupled together. Any suitable connection arrangement may be used. For the example, the first member uphole section and the first member mid-section may be coupled together by at least one of a thread connection, a mechanical connector or the like. The first member mid-section and the first member downhole section may be coupled together. Any suitable connection arrangement may be used. For the example, the first member mid-section and the first member downhole section may be coupled together by at least one of a thread connection, a mechanical connector or the like.

In some embodiments, the first member may comprise a lateral fluid passage. The first member flow passage may be of any suitable form and construction. The first member flow passage may comprise at least one fluid port. In particular embodiments, the first member flow passage may comprise a single port. In other embodiments, the first member flow passage may comprise a plurality of ports. In embodiments where the first member flow passage comprises a plurality of ports, two or more of the ports may be arranged circumferentially. Alternatively, or additionally, two or more of the ports may be arranged axially. The at least one flow port of the first member may be of any suitable form. The at least one flow port of the first member may be circular. The at least one flow port of the first member may be oval.

The tool may comprise a second member operatively associated with the first member.

The second member may be of any suitable form and construction. The second member may be disposed adjacent to the first member. The second member may be disposed at least partially around the first member. The second member may be tubular. The second member may comprise a sleeve. The second member may comprise an outer sleeve. In particular embodiments, the second member may comprise a single or unitary component. In other embodiments, the second member may comprise a plurality of components. The second member may comprise an inner surface, an outer surface and end faces.

The second member may comprise a lateral flow passage. The second member flow passage may be of any suitable form and construction. The second member flow passage may comprise at least one fluid port. The second member flow passage may comprise a single port. In particular embodiments, the second member flow passage may comprise a plurality of ports, for example but not exclusively four or more ports. In embodiments where the second member flow passage comprises a plurality of ports, two or more of the ports may be arranged circumferentially. Alternatively, or additionally, two or more of the ports may be arranged axially. The at least one flow port of the second member may be of any suitable form. The at least one flow port of the second member may be circular. The at least one flow port of the second member may be oval.

A plug may be secured or otherwise provided in the second member flow passage. The plug may be of any suitable form and construction. The plug may comprise a silicon plug, although it will be recognised that any suitable plug material may be utilised.

The flow area of the lateral flow passage of the second member may be substantially equal to the flow area of the lateral flow passage of the first member. Alternatively, and in particular embodiments, the tool may comprise a choke. For example, the flow area of the lateral flow passage of the second member may be less than the flow area of the lateral flow passage of the first member.

At least one of the first member and the second member may be configured to move relative to the other of the first member and the second member. The first member may be configured to move relative to the second member to move the activation apparatus between the first configuration and the second configuration. The first member may be configured to slide axially relative to the second member to move the apparatus between the first configuration and the second configuration.

The first member may be configured to move relative to the second member to move the apparatus between the first configuration and the primed configuration. In particular embodiments, the first member may be configured to slide axially relative to the second member to move the apparatus between the first configuration and the primed configuration.

The first member may be configured to move relative to the second member to move the apparatus between the primed configuration and the second configuration. The first member may be configured to slide axially relative to the second member to move the apparatus between the primed configuration and the second configuration.

In some embodiments, the tool may be configured so that the lateral flow passage, e.g. flow port, of the second member is initially disposed uphole of the lateral flow passage, e.g. flow port, of the first member. In other embodiments, the tool may be configured so that the lateral flow passage, e.g. flow port, of the second member is initially disposed downhole of the lateral flow passage, e.g. flow port, of the first member. Beneficially, initially locating the lateral flow passage of the second member downhole of the lateral flow passage prevents or mitigates the risk that frictional forces from flow through the axial flow passage or throughbore will inadvertently close the tool.

A rotational lock may be provided. Beneficially, the provision of a rotational lock assists in maintaining rotational alignment between the components of the downhole tool, in particular but not exclusively the lateral ports. The rotational lock may be disposed between the first member and the second member. The rotational lock may be configured to prevent or limit relative rotation between the first member and the second member. The rotational lock may be configured to permit axial movement of the first member and the second. The rotational lock may be of any suitable form and construction. In particular embodiments, the rotational lock may comprise a pin or screw configured to engage a groove. The screw may be provided in the second member and the groove may be provided in the first member, or vice versa.

In this embodiment, a groove or spline is formed in the inner sleeve adjacent to the port in the outer sleeve. One or more retainer or key is disposed through the outer sleeve and into the groove, the retainer provide rotational alignment between inner sleeve and the outer sleeve.

An insert may be disposed in the rotational lock and/or in other tool voids. In particular embodiments, the insert may be disposed in the groove of the rotational lock.

Beneficially, the provision of the insert permits the rotational alignment between the first and second members while also preventing or mitigating escape of grease from the tool. The insert may also or alternatively avoid clogging of the rotational lock or tool voids.

The insert may comprise a solid material or a fluid. The insert may comprise a low strength solid material, a filler or the like.

The insert may comprise a silicon material. In particular embodiments, the insert may comprise a high temperature silicon material.

The insert may comprise at least one of resin; plant resin; mastic; high temperature mastic; and 3M™ Fire Barrier Water Tight Sealant 3000 WT.

The insert may comprise an adhesive material. The provision of an adhesive material may ensure retention of the insert or filler within the tool or tool void. For example, but not exclusively, the insert or filler may be selected to permit adhesion to steel, with no or minimum surface preparation and to provide a strong adhesive bond at temperatures ranging between 100 degrees celsius to 200 degrees celsius.

The insert may comprise deformable material. The provision of a deformable material beneficially allows a tolerance when the filled void is adjacent to or interactive with other moving parts of the tool. Beneficially, the provision of a material which is yieldable/ softer than steel allows deformation and flex once the filler has dried.

In use, the groove or spline of the rotational lock may be formed in the insert or filler. For example, the retainer key may create a groove within the insert or filler deformation or by shaving off a layer of the insert.

The surface of the groove or tool void may be cleaned prior to application of the insert or filler. Where the insert or filler comprises a fluid or adhesive material, the insert may be allowed to set prior to assembly of the tool.

The provision of the silicon material provides a further benefit in that the silicon retains its position in the groove and so will not itself escape into the formation or in applications where it may not be desirable to use plugs, such as the silicon plugs described above.

In some embodiments, the insert may be used in place of plugs. However, in other embodiments, both the insert and plugs may be used where appropriate.

The tool may comprise at least one further lateral bore. The further lateral bore may be configured to receive a grease fill port or the like.

The tool may comprise a connection arrangement for coupling the downhole tool to a tubular string. The connection arrangement may be of any suitable form and construction.

The connection arrangement may comprise a connector for coupling the downhole tool to an uphole component of the tubular string. In some embodiments, the connector for coupling the tool to an uphole component of the tubular string may be integral to the second member. In particular embodiments, the connector for coupling the tool to an uphole component of the tubular string may comprise a separate component, in particular but not exclusively a top sub or the like.

The connection arrangement may comprise a connector for coupling the tool to a downhole component of the tubular string. In some embodiments, the connector for coupling the tool to a downhole component of the tubular string may be integral to the second member. In particular embodiments, the connector for coupling the tool to a downhole component of the tubular string may comprise a separate component, in particular but not exclusively a bottom sub or the like.

At least one of the uphole connector and the downhole connector may comprise a threaded connector or the like. At least one of the uphole connector and the downhole connector may comprise a threaded box connector. At least one of the uphole connector and the downhole connector may comprise a threaded pin connector.

The apparatus may be configured so that in the first, run-in, configuration the first member fluid passage and the second member fluid passage are not aligned. In use, the apparatus may be configured to be run into a borehole in the first configuration.

The downhole tool may be configured so that in the second configuration the first member fluid passage and the second member fluid passage are aligned or at least partially aligned. In use, movement of the apparatus from the first configuration to the second configuration may permit lateral passage of fluid through the apparatus. Alternatively, the first member or the second member may comprise a lateral flow passage. For example, only the second member may comprise a lateral flow passage, movement of the first member covering and uncovering the lateral flow passage of the second member.

The tool may be configured to be run into a borehole as part of a tubular string, for example but not exclusively a completion string, running string, drill string or the like. The tool may be configured for location at any location in the string. In some embodiments, the tool may be configured for location at or near the distal most end or toe of the tubular string.

The downhole tool may be configured to be run into a cased borehole section.

The downhole tool may be configured to be run into an open or unlined borehole section.

In some embodiments, the downhole tool may be configured with open distal end. In cased hole applications, for example, the provision of a downhole tool configured with an open distal end may permit a settable material, for example but not exclusively cement or the like, to be pumped through the downhole tool, and for example through the completion string, into an annulus between the tool and a wall of the borehole for circulation or other suitable applications. Beneficially, the provision of one or both of the at least one grease fill port and the plug avoids clogging voids in the tool with the settable material.

The downhole tool may be configured to receive and/or permit passage of a wiper dart or the like. In use, the wiper dart may follow the settable material and may be pumped downhole, for example with water or the like. In some embodiments, the downhole tool may comprise a profile for receiving the wiper dart, thereby permitting the end of the tool and/or a tubular string to be closed. The wiper dart may alternatively engage a profile below the downhole tool, for example in another downhole tool of a tubular string, to close the end of the string.

In other embodiments, the downhole tool may be configured with a closed distal end. In such embodiments, the completion string may be closed at the downhole tool and thus no further operations may be required before an operation, for example a pressure test, can be carried out. In such embodiments, the at least one grease fill ports and the plug may optionally be omitted.

In some embodiments, the downhole tool may be configured for fracturing a well and/or borehole, for example an oil or gas well borehole. The downhole tool may comprise a fracturing tool.

In some embodiments where the downhole tool is configured for fracturing operations, the downhole tool may be disposed in an opposite orientation to that used for circulation operations, or alternative fracturing operation embodiments, in which embodiments references to uphole and downhole directions may be reversed. In use, once the downhole tool has been located downhole and the activation apparatus and downhole tool have been configured in the second configuration fracturing fluid may be pumped or otherwise directed through the tool, for example through the fluid flow passage to fracture the zone. Beneficially, disposing the downhole tool in the reverse orientation may prevent forces generated by the flow of fracturing fluid inadvertently causing premature or otherwise unintended transition of the downhole tool to a closed configuration, since the activation arrangement and/or the first member of the downhole tool may be disposed downhole of the flow passage.

At least one of the uphole connector, downhole connector and the first member may comprise tapered or angled end faces. For example, a lower end face of the uphole connector and an upper end face of the first member may comprise a taper or angle. A lower end face of the first member and an upper end face of the downhole connector may be tapered or angled. Beneficially, the tapered end faces assist in driving grease from the tool during operation.

According to a third aspect of the present invention there is provided a tubular string comprising at least one activation apparatus according to the first aspect of the invention.

The string may comprise a completion string. The string may comprise a running string, drill string or the like.

The string may comprise a single activation apparatus according to the first aspect.

The string may comprise a plurality of the activation apparatus according to the first aspect.

The completion string may comprise at least one downhole tool.

The completion string may comprise a plurality of downhole tools.

At least one of the downhole tools may comprise a downhole tool according to the second aspect. In particular embodiments, a plurality of the tools may comprise a tool according to the second aspect.

The string may comprise at least one other downhole tool.

In some embodiments, every tool of the string may comprise an activation apparatus according to the first aspect or a downhole tool according to the second aspect. Beneficially, where every tool of the string comprises the activation apparatus according to the present invention the full string may be subject to an operations and/or test at forces and pressures which previously could not be achieved or would not be performed due to the risk of premature activation.

The at least one other downhole tool may comprise a mechanical counter device, such as described in WO 2011/117601, which is incorporated herein in its entirety.

The at least one other downhole tool may comprise a downhole actuating apparatus, such as described in WO 2011/117602, which is incorporated herein in its entirety.

The at least one other downhole tool may comprise a packer.

The at least one other downhole tool may comprise a sliding sleeve.

According to a fourth aspect of the present invention there is provided a method, the method comprising applying at least two forces to an activation apparatus to transition the activation apparatus from a first configuration to a second configuration.

According to a fifth aspect of the present invention there is provided a method comprising: preventing or at least mitigating the risk of premature activation of a downhole tool caused by inadvertent application of a force or pressure sufficient to cause activation of the tool, and optionally applying a test pressure up to or exceeding a pressure sufficient to cause activation of the downhole tool.

The activation apparatus may comprise an activation apparatus according to the first aspect of the invention.

The method may comprise a method for activating a downhole tool. The downhole tool may comprise a downhole tool according to the second embodiment and/or at least one other tool, such as described above in any of the previous aspects.

The method may comprise a method for fracturing a well.

The method may comprise a method for circulating fluid in a well.

The method may comprise transitioning the activation apparatus from the first configuration to the second configuration in a plurality of stages.

The first configuration may comprise a run-in configuration.

The second configuration may comprise an activation configuration.

The method may comprise transitioning the activation apparatus from the first configuration to a third configuration. The third configuration may comprise a primed or intermediate configuration for example.

The method may comprise transitioning the activation apparatus from the first configuration to the primed configuration by applying, or following application of, a first of the at least two forces.

The method may comprise transitioning the activation apparatus from the primed configuration to the second configuration by application of, or following application of, a second or subsequent force.

In use, application of a first of the at least two forces may not transition the activation apparatus from the first configuration to the second configuration, the activation apparatus transitioning to the second configuration by application of, or following application of, a second or subsequent force.

The method may comprise running the tool downhole locked in the first configuration.

The method may comprise unlocking the activation apparatus from the first configuration to transition the activation apparatus from the first configuration to the primed configuration.

Unlocking the activation apparatus from the first configuration may occur simultaneously with, or as a result of, increasing pressure in the tool throughbore.

The method may comprise using a force applicator within the tool to apply a force to the activation apparatus to transition the tool from the first configuration to the primed configuration.

The method may comprise locking the tool in the primed configuration.

Locking the tool in the primed configuration may occur simultaneously with, or as a result of, reducing pressure in the tool throughbore.

The method may comprise unlocking the activation apparatus from the primed configuration to transition the activation apparatus from the primed configuration to another intermediate configuration or the second configuration. Unlocking the activation apparatus from the primed configuration may occur simultaneously with, or as a result of, increasing the pressure in the tool throughbore. The increased pressure to unlock the activation apparatus from the primed configuration may be less than the increased pressure required to unlock the activation apparatus from the first configuration.

The method may comprise using a force applicator within the tool to apply a force to the activation apparatus to transition the tool from the primed configuration to the intermediate configuration or the second configuration.

The method may comprise pressure testing the tool.

Pressure testing the tool may comprise increasing the pressure in a tool throughbore.

According to a sixth aspect of the present invention there is provided a downhole tool comprising at least one void, wherein the at least one void receives an insert or filler comprising an adhesive yieldable material.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
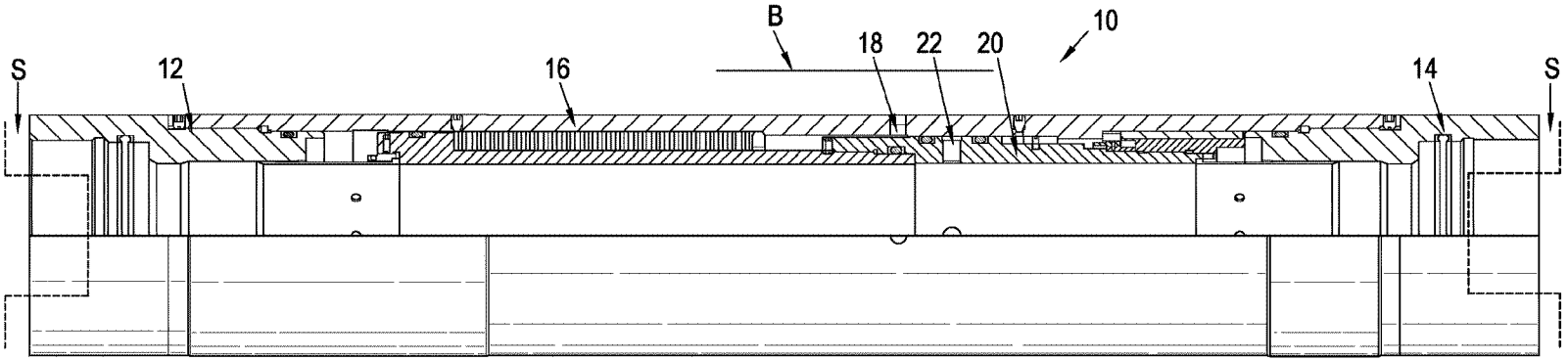
FIG. 1 is a longitudinal cut-away view of an apparatus according to an embodiment of the present invention, shown in a run-in configuration.

Referring first to FIG. 1, there is shown a longitudinal cut away view of an apparatus 10 according to an embodiment of the present invention. As shown in FIG. 1, the apparatus 10 has a top sub 12, a bottom sub 14, an outer sleeve 16 having a port 18 and an inner sleeve 20 having a port 22.

Figure 11:
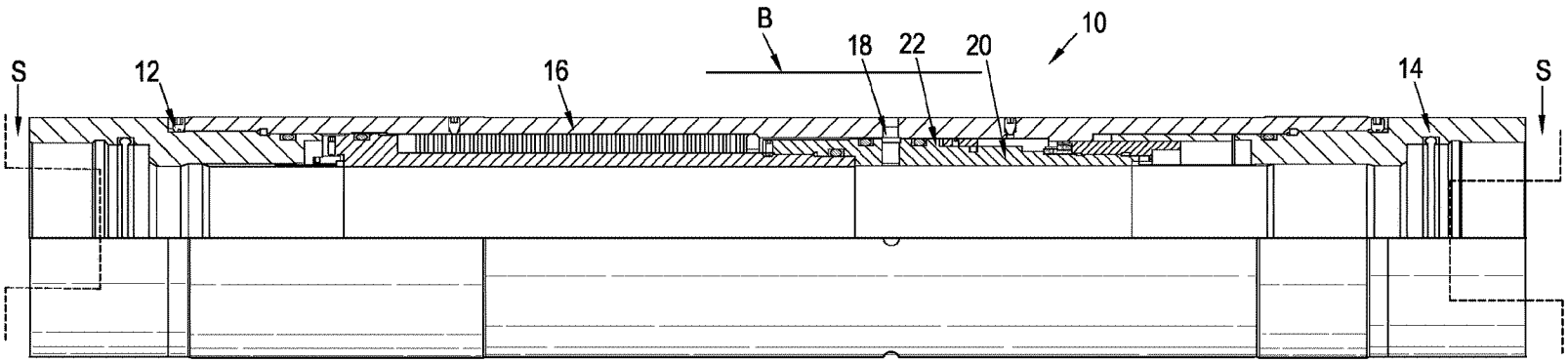
FIG. 11 is a longitudinal cut-away view of the apparatus, shown in the activation configuration.
Figure 10:
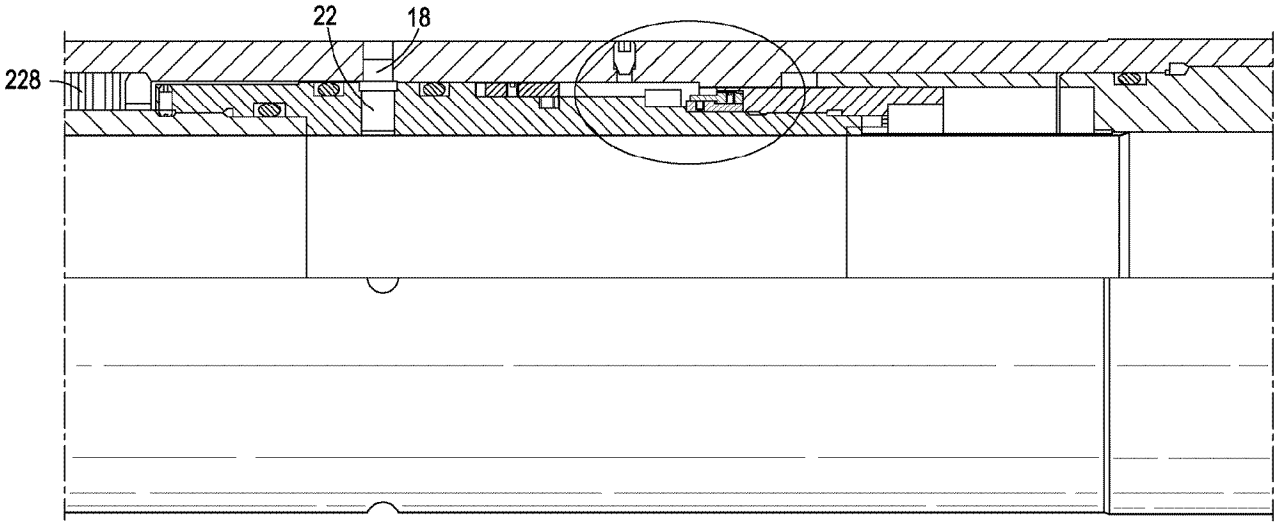
FIG. 10 is an enlarged view of the section of the apparatus shown in FIG. 5, in the activated configuration.

According to a first embodiment, in use, the apparatus 10 takes the form of a toe sleeve which is coupled to and forms part of a completion string (shown diagrammatically by S) which is run into a borehole (shown diagrammatically by B). The apparatus 10 is configurable between a run-in configuration in which the ports 18, 22 are not aligned (as shown in FIG. 1) and an activated position in which the ports 18, 22 are aligned and permit lateral passage of fluid through the apparatus 10 (as shown in FIGS. 10 and 11) which may be used, for example in well fracturing operations.

Figure 2:
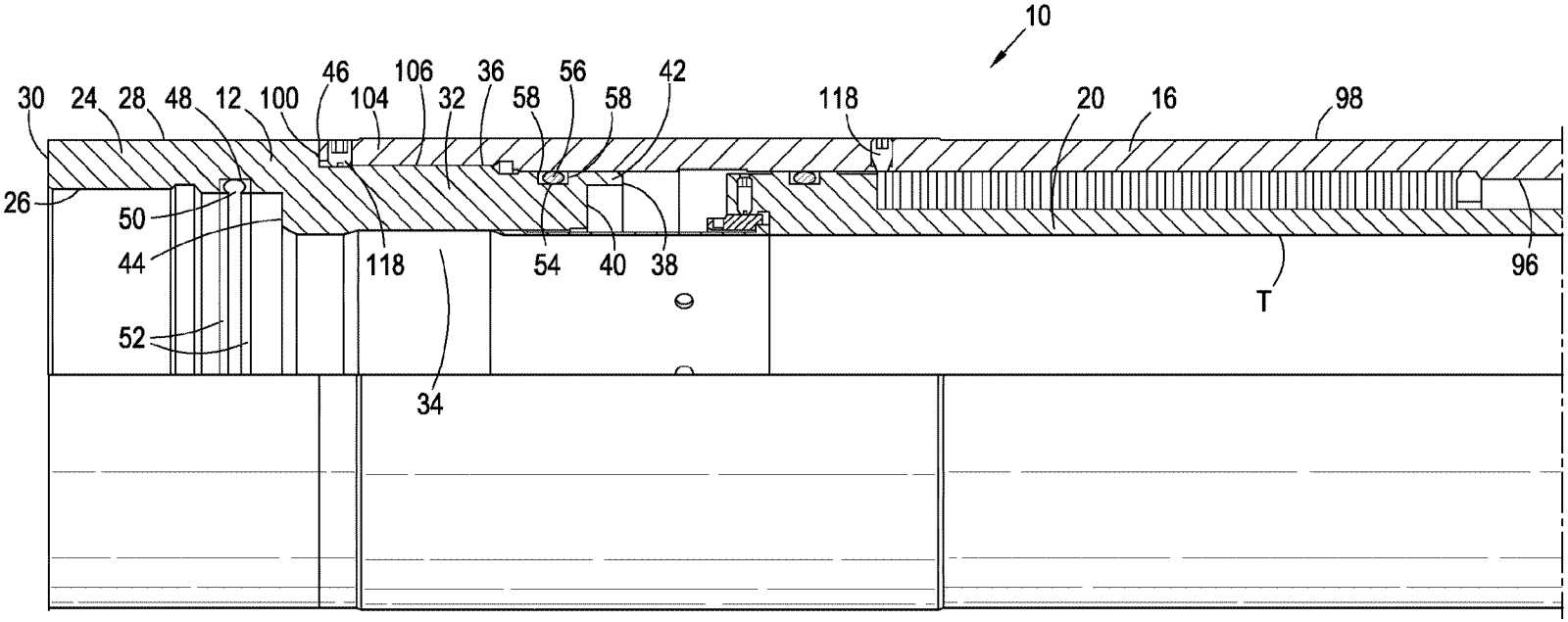
FIG. 2 is an enlarged view of an uphole region of the apparatus shown in FIG. 1.

Referring now also to FIG. 2, which shows an enlarged longitudinal cut away view of an upper region of the apparatus 10 shown in FIG. 1, it can be seen that the top sub 12 is generally tubular and forms the uphole end of the apparatus 10 in use (left end as shown in the figures). An upper section 24 of the top sub 12 has an inner surface 26, an outer surface 28 and an end face 30 and a lower section 32 of the top sub 12 has an inner surface 34, an outer surface 36 and end faces 38, 40, the end face 38 disposed on a flange portion 42 extending from the top sub lower section 32. An inner shoulder 44 forms the interface between the inner surfaces 26, 34. An outer shoulder 46 forms the interface between the outer surfaces 28, 36. A groove 48 is formed in the inner surface 26 and a seal element in the form of o-ring seal 50 is disposed in the groove 48. In the illustrated embodiment, the seal 50 is provided with two seal back-up rings 52. A groove 54 is also formed in the outer surface 36 and a seal element in the form of o-ring seal 56 is disposed in the groove 54. In the illustrated embodiment, the seal 56 is provided with two seal back-up rings 58.

Figure 3:
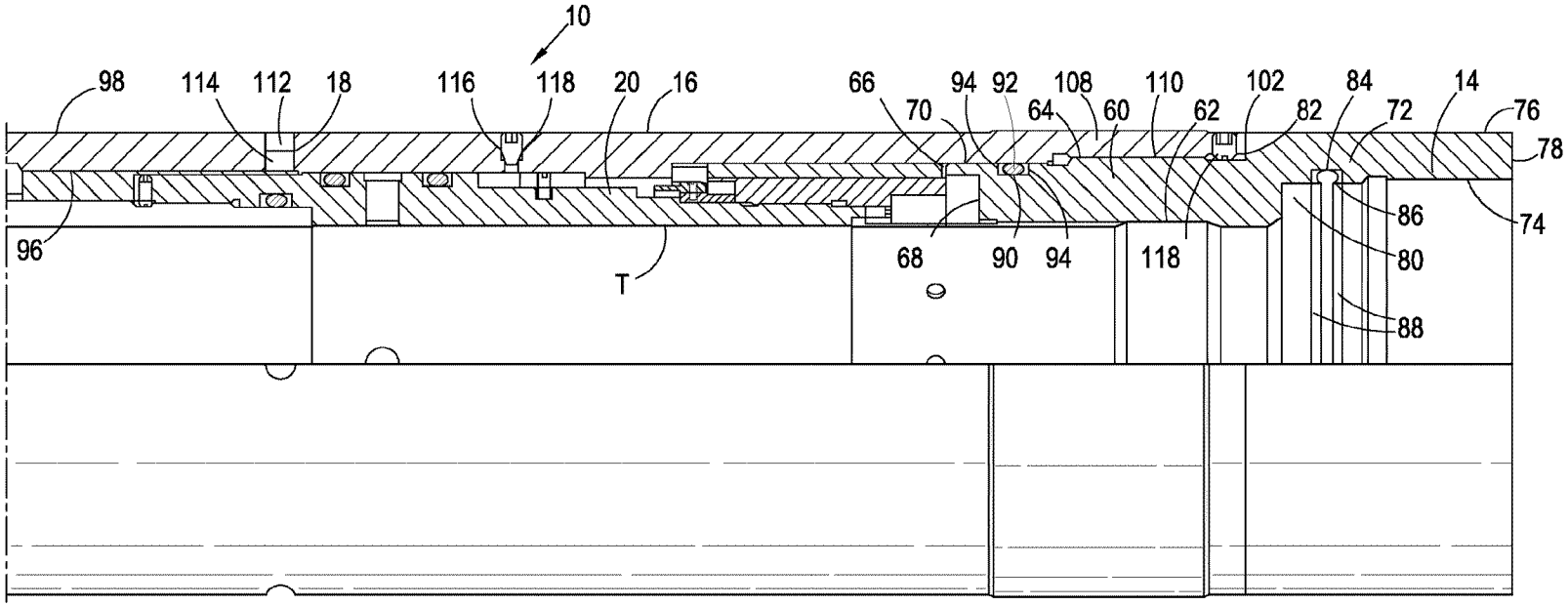
FIG. 3 is an enlarged view of a downhole region of the apparatus shown in FIGS. 1 and 2.

Referring now also to FIG. 3, which shows an enlarged longitudinal cut away view of a lower region of the apparatus 10 shown in FIGS. 1 and 2, it can be seen that the bottom sub 14 is generally tubular and forms the downhole end of the apparatus 10 (right end as shown in the figures and closest to the toe of the well in use). An upper section 60 of the bottom sub 14 has an inner surface 62, an outer surface 64 and end faces 66, 68, the end face 66 disposed on a flange portion 70 extending from the bottom sub upper section 60. A lower section 72 of the bottom sub 14 has an inner surface 74, an outer surface 76 and an end face 78. An inner shoulder 80 forms the interface between the inner surfaces 62, 74. An outer shoulder 82 forms the interface between the outer surfaces 64, 76. A groove 84 is formed in the inner surface 74 and a seal element in the form of o-ring seal 86 is disposed in the groove 84. In the illustrated embodiment, the seal 86 is provided with two seal back-up rings 88. A groove 90 is also formed in the outer surface 64 and a seal element in the form of o-ring seal 92 is disposed in the groove 90. In the illustrated embodiment, the seal 92 is provided with two seal back-up rings 94.

In use, the apparatus 10 is coupled to an adjacent uphole component of string S via the top sub 12 and to an adjacent downhole component of the sting S via the bottom sub 14. In the illustrated embodiment, the top sub 12 and the bottom sub 14 define threaded box connections, although it will be understood that either or both of the top sub 12 and the bottom sub 14 may alternatively define a threaded pin connection or any other suitable connector.

As shown in FIGS. 2 and 3, the outer sleeve 16 extends between the top sub 12 and the bottom sub 14 and is generally tubular in construction, having an inner surface 96, an outer surface 98 and end faces 100, 102.

On assembly, the apparatus 10 is configured so that an uphole end region 104 of the outer sleeve 16 is disposed on the top sub lower section 32 and secured via thread connection 106 (as shown most clearly in FIG. 2) while a downhole end region 108 of the outer sleeve 16 is disposed on the bottom sub upper section 60 and secured via thread connection 110 (as shown most clearly in FIG. 3). As can be seen from the figures, the end face 100 of the outer sleeve 16 abuts the top sub outer shoulder 46. The end face 102 abuts the bottom sub outer shoulder 82. The sleeve outer surface 98, the top sub outer surface 28 and the bottom sub outer surface 76 define a substantially continuous outer surface of the apparatus 10. The tubular top sub 12, inner sleeve 20 and bottom sub 14 have a central longitudinal passageway defining a throughbore T.

As shown most clearly in FIG. 3, the outer sleeve lateral port 18 extends laterally through the outer sleeve 16 in a direction perpendicular to the throughbore T. A silicon plug 112 is secured in the port 18 and the remaining volume 114 of the port 18 is filled with grease or the like. In addition to the port 18, a number of lateral bores 116 are provided in the outer sleeve 16, the bores 116 defining or receiving a grease fill port 118, and in the illustrated embodiment four grease fill ports 118 are provided.

In the illustrated embodiment, the outer sleeve 16 is a unitary construction, although it will be recognised that in other embodiments the outer sleeve 16 may be constructed from a number of components secured together. In the illustrated embodiment, the inner sleeve 20 is constructed from a number of components coupled together, as will be described further below with reference to FIG. 4.

Figure 4:
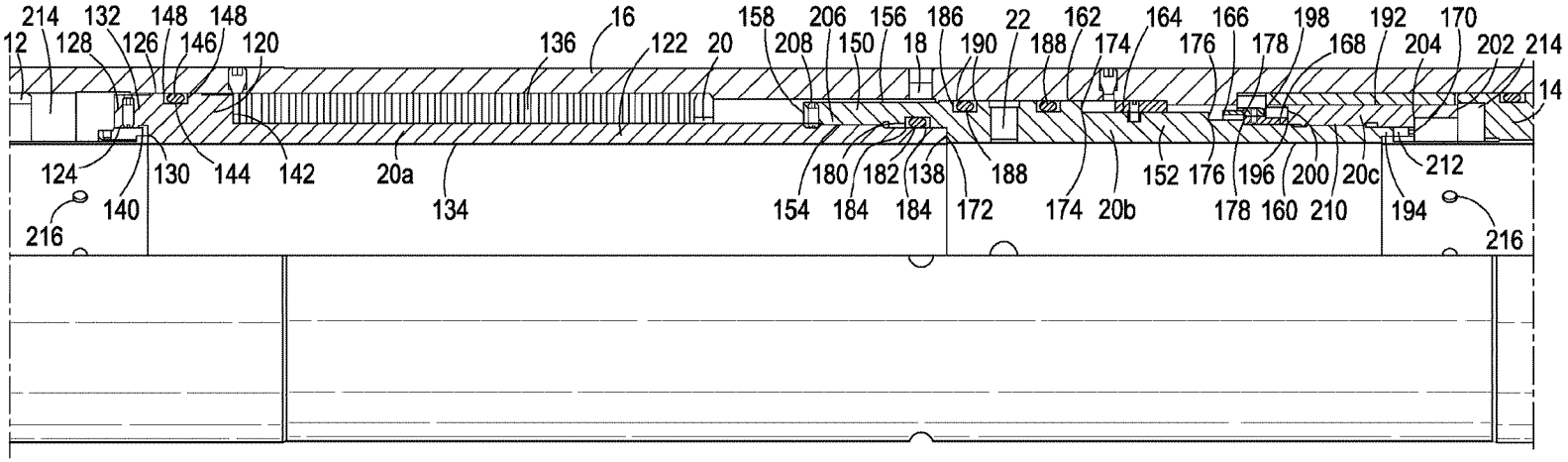
FIG. 4 is an enlarged view of a mid-section of the apparatus shown in FIGS. 1 to 3.

As shown in FIG. 4, the inner sleeve 20 is generally tubular and is disposed between the top sub 12 and the bottom sub 14 and radially inwards of the outer sleeve 16. In use, the inner sleeve 20 slides axially relative to the outer sleeve 16 between the top sub 12 and bottom sub 14 to move the apparatus 10 between the run-in configuration in which the lateral ports 18, 22 are not aligned and the activated configuration in which the ports 18, 22 are aligned and permit lateral passage of fluid through the apparatus 10, for example to perform a circulation or well fracturing operation.

The inner sleeve 20 comprises uphole section 20*a*, mid-section 20*b* and downhole section 20*c*. In the illustrated embodiment, the lateral port 22 is provided in the mid-section 20*b*.

The uphole section 20*a* of inner sleeve 20 has an upper section 120 and a lower section 122. The upper section 120 has an inner surface 124, an outer surface 126 and end faces 128, 130, the end face 128 disposed on a flange portion 132. The lower section 122 has an inner surface 134, an outer surface 136 and an end face 138, the lower section 122 being recessed relative to the upper section 120 (that is, the lower section 122 is of reduced outer diameter than the upper section 120). An inner shoulder 140 forms the interface between the inner surfaces 124, 134. An outer shoulder 142 forms the interface between the outer surfaces 126, 136. A groove 144 is formed in the outer surface 126 and a seal element in the form of o-ring seal 146 is disposed in the groove 144. In the illustrated embodiment, the seal 146 is provided with two seal back-up rings 148.

Mid-section 20*b* of inner sleeve 20 has an upper section 150 and a lower section 152. The upper section 150 has an inner surface 154, an outer surface 156 and an end face 158 while the lower section 152 has an inner surface 160, a stepped outer surface with steps 162, 164, 166, 168 and an end face 170. An inner shoulder 172 forms the interface between the inner surfaces 154, 160. Outer shoulders 174, 176, 178 form the interfaces between the steps 162, 164, 166

168. A groove 180 is formed in the inner surface 154 and a seal element in the form of o-ring seal 182 is disposed in the groove 180. In the illustrated embodiment, the seal 182 is provided with two seal back-up rings 184. Two grooves 186 are formed in the outer surface 156, each groove 186 having a seal element in the form of an o-ring seal 188 disposed therein. In the illustrated embodiment, the seals 188 are each provided with two seal back-up rings 190. As can be seen from FIG. 3 for example, the seals 188 straddle the inner sleeve lateral port 22 and are interposed between the inner sleeve 20 and the outer sleeve 16, preventing fluid leakage around the lateral port 22 in use.

Downhole section 20*c* of inner sleeve 20 has an outer surface 192, a stepped inner surface 194 having inner shoulder 196, uphole directed end faces 198, 200 and downhole directed end faces 202, 204.

As can be seen from FIG. 4, the inner sleeve sections 20*a*, 20*b*, 20*c* are overlapped: the upper section 150 of mid-section 20*b* is disposed around the lower section 122 of the uphole section 20*a;* the downhole section 20*c* is disposed around the lower section 152 of mid-section 20*b*. The inner sleeve sections 20*a*, 20*b*, 20*c* are also coupled together. The overlapping uphole and mid-sections 20*a*, 20*b* are secured by a threaded connection 206 and one or more grub screw 208 to restrict relative rotation of the sections 20*a*,20*b*,20*c* of the inner sleeve 20. The overlapping mid and downhole sections 20*b*, 20*c* are secured by a threaded connection 210 and one or more grub screw 212. Spaces 214 between the inner sleeve and the top sub 12 and bottom sub 14 are filled with grease or the like, and ports 216 are provided for the escape of the grease when displaced by the inner sleeve 20.

Figure 5:
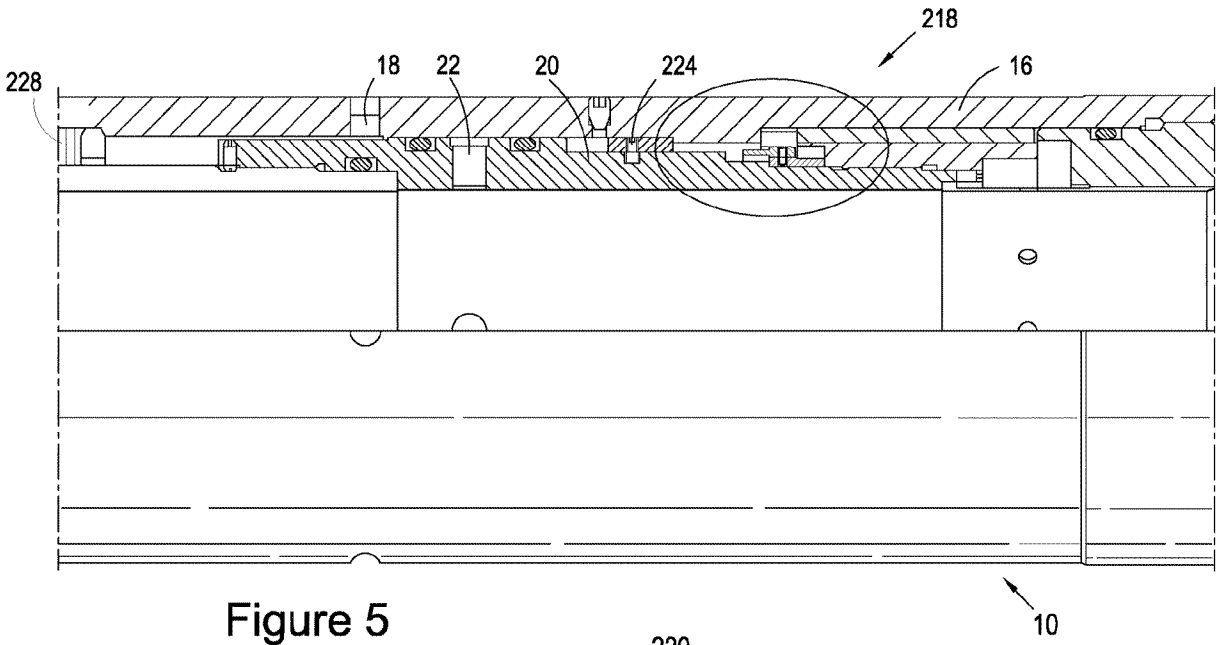
FIG. 5 is an enlarged view of a section of the apparatus shown in FIGS. 1 to 4, shown in the run-in configuration.
Figure 5A:
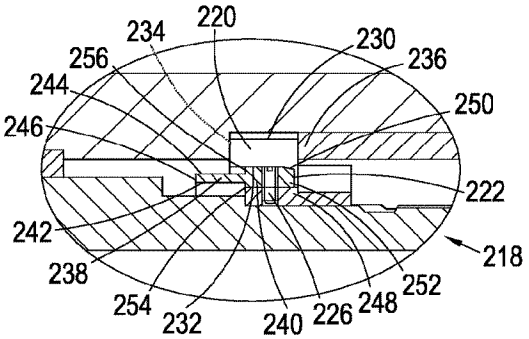
FIG. 5*a* is an enlarged view of the highlighted region of FIG. 5.

Referring now also to FIGS. 5 and 5*a*, there is shown part of an activation apparatus 218 of the apparatus 10 according to the illustrated embodiment. The activation apparatus 218 is disposed between the inner sleeve 20 and the outer sleeve 16 and, in use, facilitates movement between the run-in configuration in which the ports 18, 22 are not aligned and the activated configuration in which the ports 18, 22 are aligned and permit lateral passage of fluid through the apparatus 10, as will be described further below.

The activation apparatus 218 comprises an outer snap ring 220, an inner snap ring 222, a first stage retainer in the form of first stage shear pin 224 (see FIG. 5) disposed between the inner sleeve 20 and the outer sleeve 16, a second stage retainer in the form of second stage shear pin 226 disposed between the inner snap ring 222 and the inner sleeve 20 and a biasing member in the form of spring 228, in the illustrated embodiment a flat wire compression spring or Smalley Wave Spring.

The outer snap ring 220 comprises an annular member having an outer surface 230, an inner surface 232, an upper (uphole facing) end face 234 and a lower (downhole-facing) end face 236.

The inner snap ring 222 comprises an annular member having an upper section 238 and a lower section 240. The upper section 238 has an inner surface 242, an outer surface 244 and an end face 246. The lower section 240 has an inner surface 248, an outer surface 250 and an end face 252. An inner shoulder 254 defines the interface between the inner surfaces 242, 248. An outer shoulder 256 defines the interface between the outer surfaces 244, 250. As shown in FIG. 5*a*, second stage shear pin 226 extends through the inner snap ring 222 and into the inner sleeve 20.

Operation of the apparatus 10 will now be described with reference to all of the figures and in particular with reference to FIGS. 5 to 11.

In operation, the apparatus 10 is run into the borehole B in the run-in configuration, with the activation apparatus 218 configured as shown in FIGS. 5 and 5*a*. In this configuration, the outer snap ring 220 is supported on outer surface 250 of inner snap ring 222 and is interposed between the inner sleeve 20 and the outer sleeve 16 such that relative axial movement of the inner sleeve 20 and the outer sleeve 16 is prevented.

According to the present invention the apparatus 10 is to be used as a toe sleeve. The toe sleeve is located at a leading end of the completion string S, which may include a variety of other tools such as packers and sliding sleeves (not shown). The completion string S is then run downhole and the toe sleeve positioned as the tool closest to the toe of the well. Pressure is increased within the throughbore T by an operator at surface. The pressure is increased to 11,000 psi to test the integrity of the completion string S at this high pressure.

Figure 6:
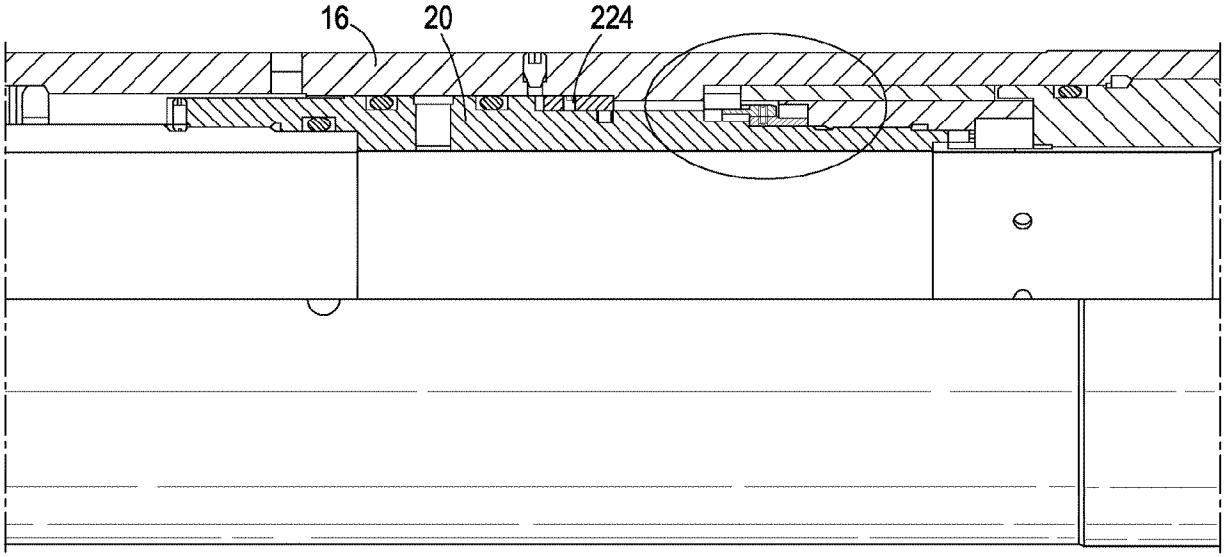
FIG. 6 is an enlarged view of the section of the apparatus shown in FIG. 5, in a second position.
Figure 6A:
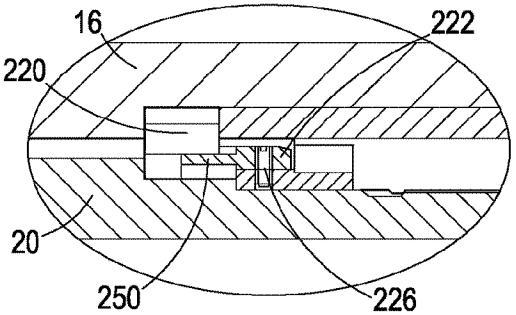
FIG. 6*a* is an enlarged view of the highlighted region of FIG. 6.

This first stage fluid pressure applied within the throughbore T and acting between the seals 146,188 of the inner sleeve 20 causes the first stage shear pin 224 to shear, shifting the inner sleeve 20 downhole (to the right as shown in the figures) relative to the outer sleeve 16 from the position shown in FIGS. 5 and 5*a* to the position shown in FIGS. 6 and 6*a*. In this position, the inner snap ring 222 remains secured to the inner sleeve 20 via second stage shear pin 226 and so shifts with the movement of the inner sleeve 20. As the inner snap ring 222 shifts downhole, the outer snap ring 220—which is axially retained by the outer sleeve 16—is no longer supported by the lower section 240 of the inner snap ring 222 and so drops down onto outer surface 244 of upper section 238 of inner snap ring 222.

Figure 7:
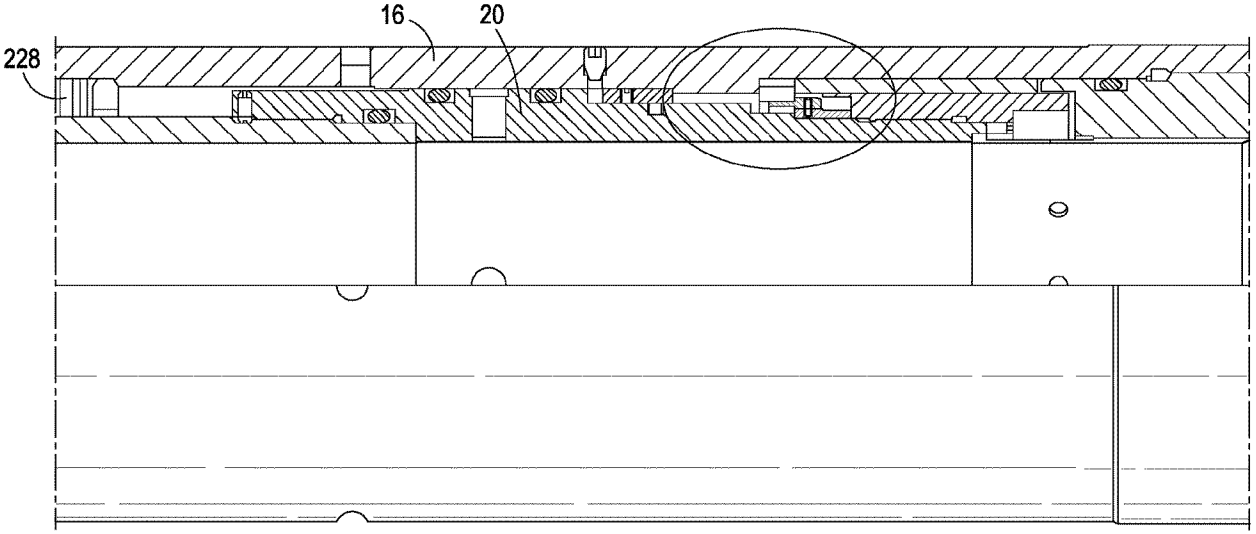
FIG. 7 is an enlarged view of the section of the apparatus shown in FIG. 5, in a third position.
Figure 7A:
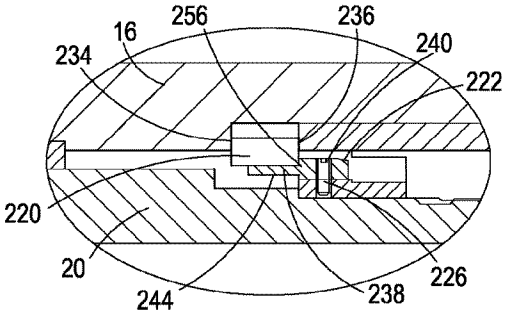
FIG. 7*a* is an enlarged view of the highlighted region of FIG. 7.

When the first stage fluid pressure applied within the throughbore T is reduced, the spring force applied by the spring 228 urges the inner sleeve 20 uphole (to the left as shown in the figures) from the position shown in FIGS. 6 and 6*a* to the position shown in FIGS. 7 and 7*a*. When this occurs, the inner snap ring 222 is prevented from moving further uphole with the inner sleeve 20 by virtue of the interlocking engagement between the shoulder 256 of inner snap ring 222 and end face 236 of upper snap ring 220 and between end face 234 of upper snap ring 220 and the outer sleeve 16.

Figure 8:
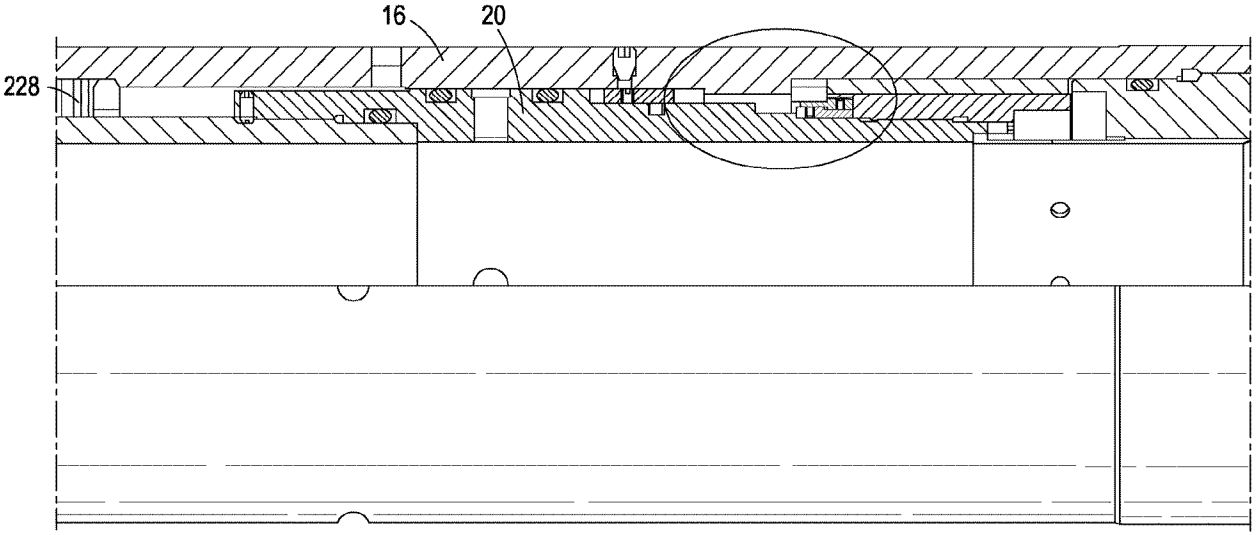
FIG. 8 is an enlarged view of the section of the apparatus shown in FIG. 5, in a fourth position.
Figure 8A:
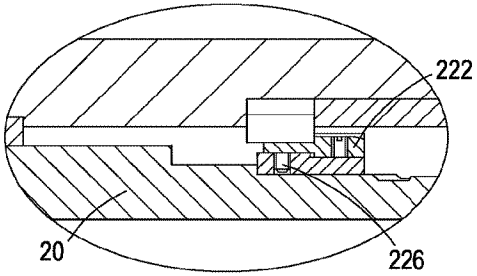
FIG. 8*a* is an enlarged view of the highlighted region of FIG. 8.

The uphole-directed spring force shears the second stage shear pin 226, and the apparatus 10 moves from the position shown in FIGS. 7 and 7*a* to the position shown in FIGS. 8 and 8*a*. In this position, since the lower snap ring 222 is no longer retained by the shear pin 226, movement of the inner sleeve 20 in the uphole direction under the influence of the spring force causes the inner snap ring 222 to drop onto the inner sleeve 20.

Figure 9:
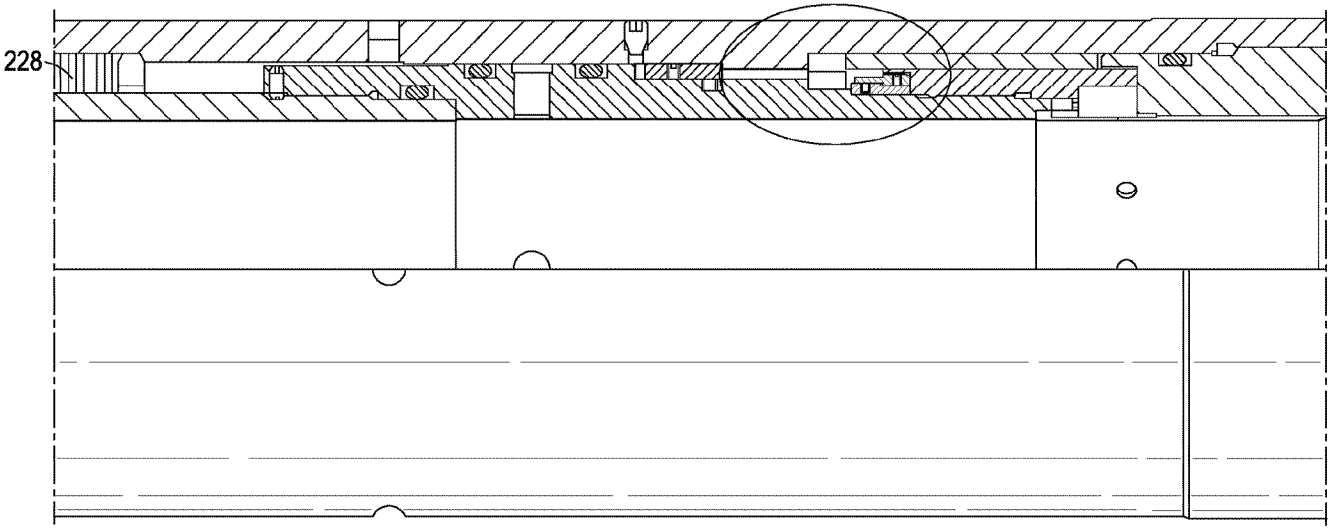
FIG. 9 is an enlarged view of the section of the apparatus shown in FIG. 5, in a fifth position.
Figure 9A:
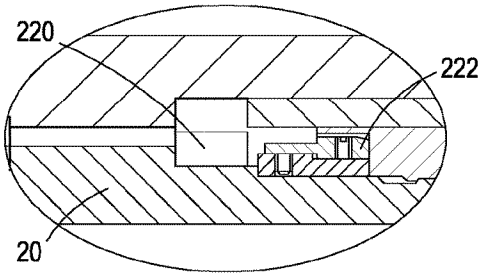
FIG. 9*a* is an enlarged view of the highlighted region of FIG. 9.

A second stage fluid pressure applied within the throughbore T and acting to cause a pressure differential between the seals 146,188 of the inner sleeve 20 causes the inner sleeve 20 to shift downhole from the position shown in FIGS. 8 and 8*a* to the position shown in FIGS. 9 and 9*a*. As can be seen from FIGS. 9 and 9*a*, because the lower snap ring 222 is seated on the inner sleeve 20, the lower snap ring 222 moves downhole with the inner sleeve 20. As the inner snap ring 222 shifts downhole, the outer snap ring 220 is no longer supported by the inner snap ring 222 and so drops down onto the inner sleeve 20. In this position, the outer snap ring 220 is no longer axially restrained by the outer sleeve 16.

Figure 10A:
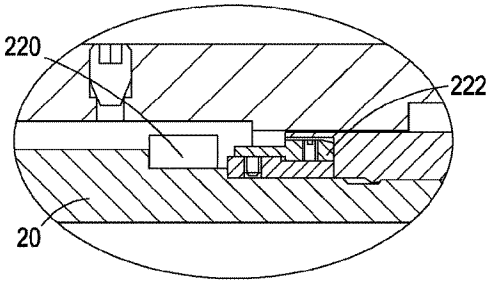
FIG. 10*a* is an enlarged view of the highlighted region of FIG. 10.

When the second stage fluid pressure is reduced in a controlled manner, the spring force applied by spring 228 urges the inner sleeve 20, together with outer snap ring 220 and inner snap ring 222, uphole from the position shown in FIGS. 9 and 9*a* to the position shown in FIGS. 10, 10*a* and 11, in which position the apparatus 10 defines the activated configuration. As can be seen from FIGS. 10, 10*a* and 11, in this position, the ports 18, 22 are aligned and fluid passage through the apparatus 10 is permitted.

It will thus be recognised that in embodiments of the present invention, a first application of a pressure force of sufficient magnitude to activate the apparatus 10 does not result in premature activation of the apparatus 10, activation of the apparatus 10 only occurring on second application of the pressure force of sufficient magnitude to activate the apparatus 10.

Figure 12:
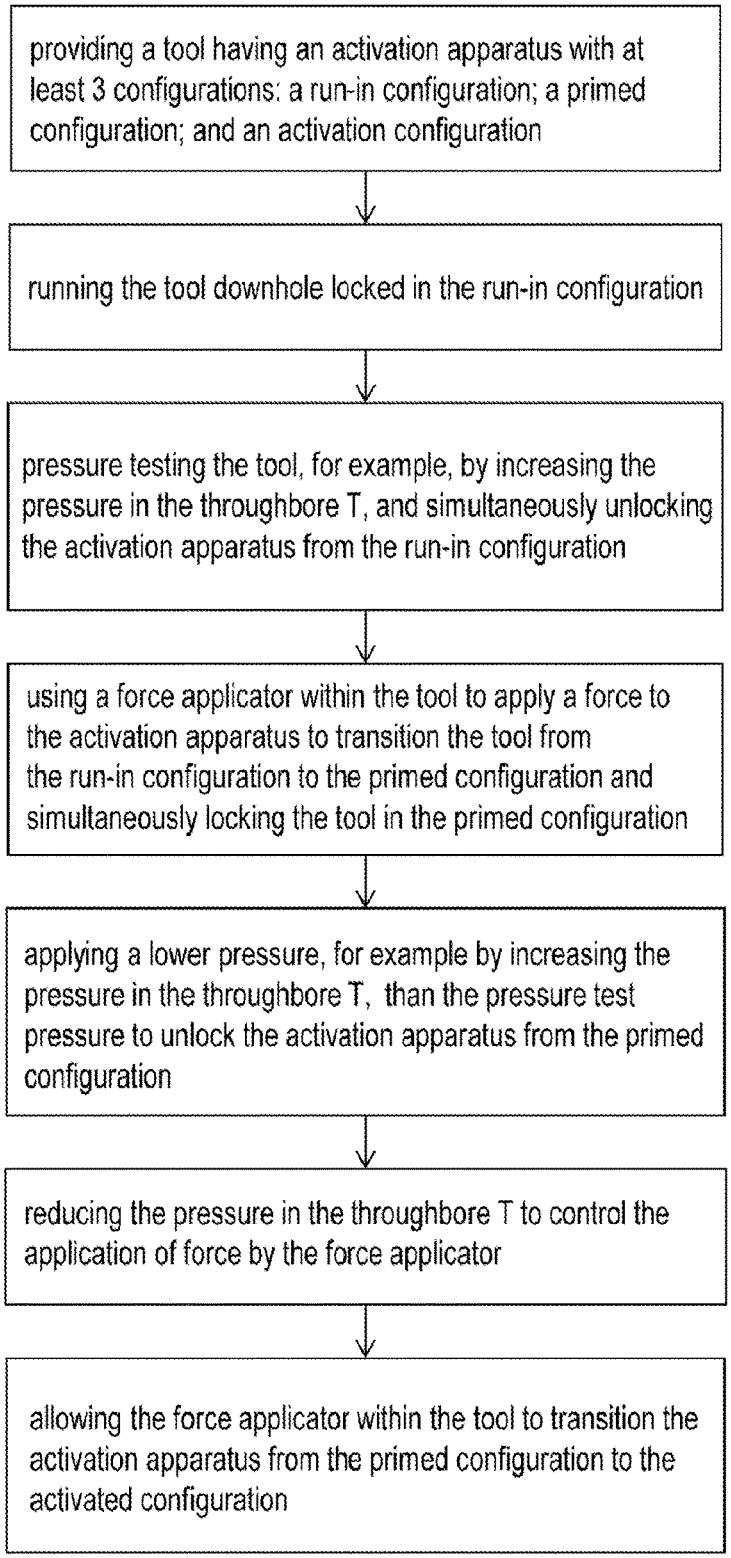
FIG. 12 is a flow chart showing a method according to an exemplary embodiment of the present invention.

FIG. 12 describes a flow chart showing a method according to an exemplary embodiment of the present invention. The method may comprise at least one of: providing a tool having an activation apparatus with at least 3 configurations: a run-in configuration; (ii) a primed configuration; and an activation configuration; running the tool downhole locked in the run-in configuration; pressure testing the tool, for example, by increasing the pressure in the throughbore T, and simultaneously unlocking the activation apparatus from the run-in configuration; using a force applicator within the tool to apply a force to the activation apparatus to transition the tool from the run-in configuration to the primed configuration and simultaneously locking the tool in the primed configuration; applying a lower pressure, for example by increasing the pressure in the throughbore T, than the pressure test pressure to unlock the activation apparatus from the primed configuration; reducing the pressure in the throughbore T to control the application of force by the force applicator; and allowing the force applicator within the tool to transition the activation apparatus from the primed configuration to the activated configuration.

It will be understood that the terms uphole, downhole, upper and lower are used to assist in the understanding of the invention and that the apparatus may be used in any required orientation.

Referring now to FIGS. 13 to 23, there is shown an apparatus 1010 according to a second embodiment of the present invention. The apparatus 1010 is similar to the apparatus 10 and like components are represented by like numerals incremented by 1000. As can be seen from the figures, the apparatus 1010 differs from the apparatus 10 in that components of the apparatus 1010 are oriented in the opposite direction to those of the apparatus 10.

Figure 13:
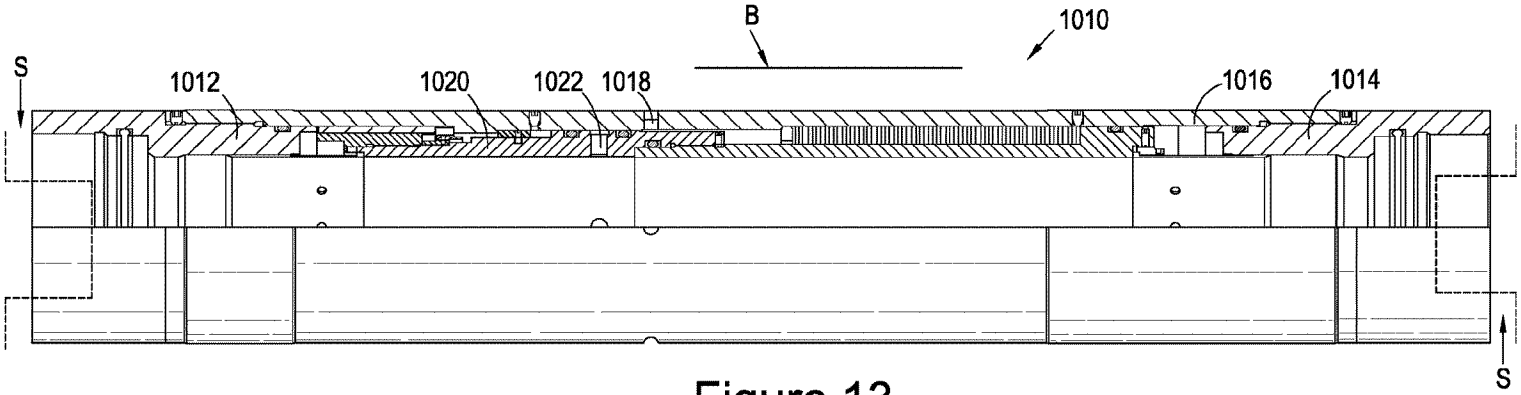
FIG. 13 is a longitudinal cut-away view of an apparatus according to a second embodiment of the present invention, shown in a run-in configuration.

Referring first to FIG. 13, there is shown a longitudinal cut away view of the apparatus 1010. As shown in FIG. 13, the apparatus 1010 has a top sub 1012, a bottom sub 1014, an outer sleeve 1016 having a port 1018 and an inner sleeve 1020 having a port 1022.

Figure 23:
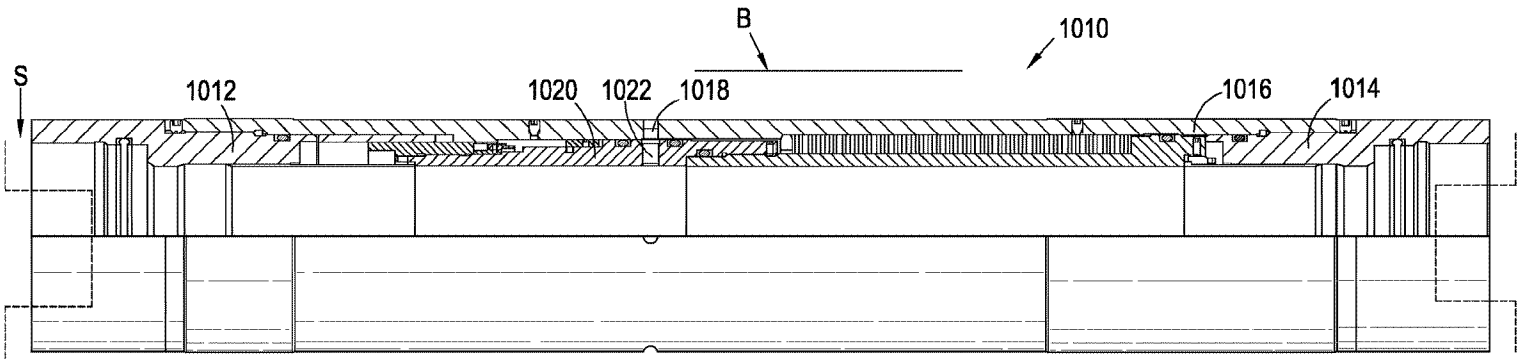
FIG. 23 is a longitudinal cut-away view of the apparatus, shown in the activation configuration.
Figure 22:
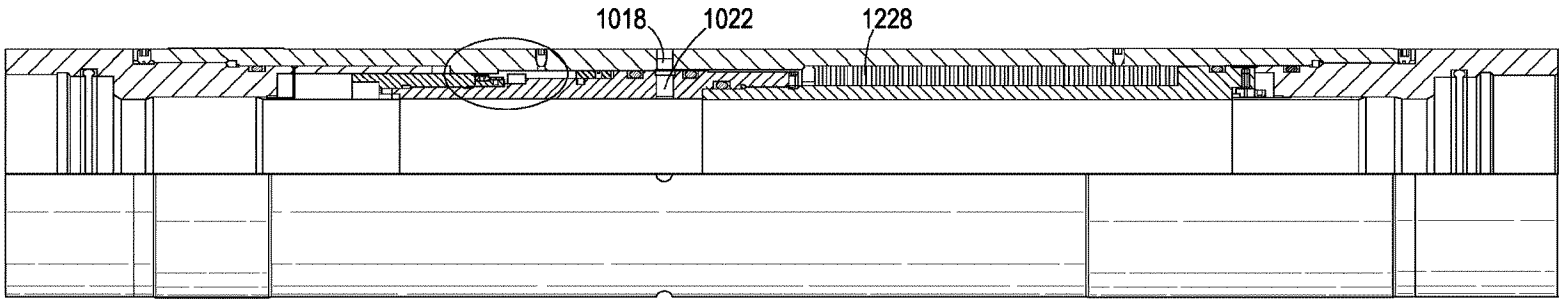
FIG. 22 is an enlarged view of the section of the apparatus shown in FIG. 17 in the activated configuration.
Figure 22A:
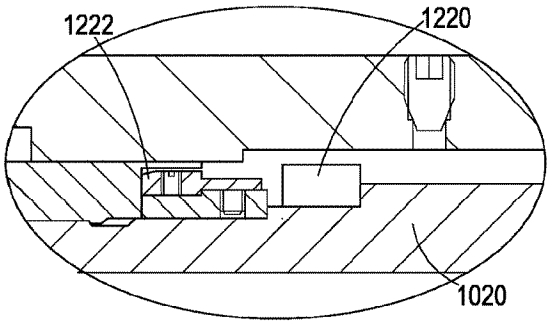
FIG. 22*a* is an enlarged view of the highlighted region of FIG. 22.

As in the apparatus 10, in this second embodiment the apparatus 1010 takes the form of a toe sleeve which is coupled to and forms part of a completion string (shown diagrammatically by S) which is run into a borehole (shown diagrammatically by B). The apparatus 1010 is configurable between a run-in configuration in which the ports 1018, 1022 are not aligned (as shown in FIG. 13) and an activated position in which the ports 1018, 1022 are aligned and permit lateral passage of fluid through the apparatus 1010 (as shown in FIGS. 22, 22*a* and 23) which may be used, for example in well fracturing operations.

Figure 14:
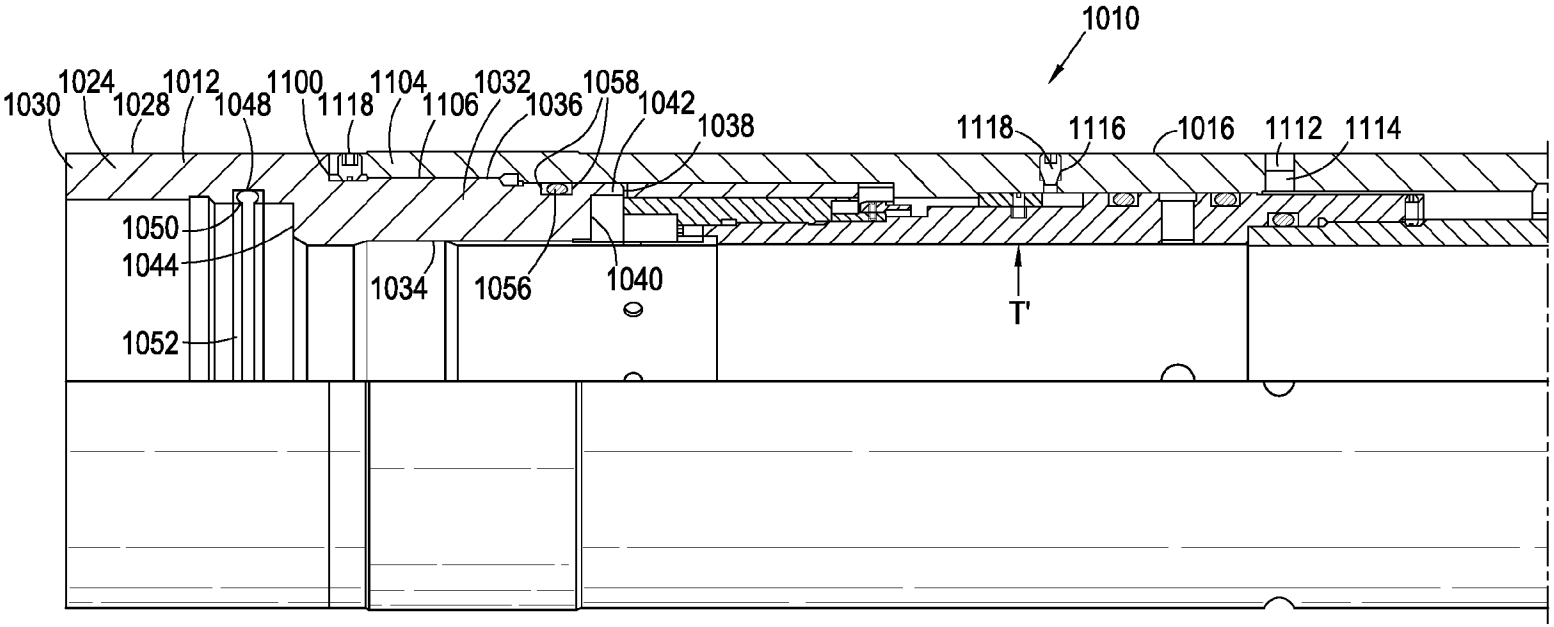
FIG. 14 is an enlarged view of an uphole region of the apparatus shown in FIG. 13.

Referring now also to FIG. 14, which shows an enlarged longitudinal cut away view of an upper region of the apparatus 1010 shown in FIG. 13, it can be seen that the top sub 1012 is generally tubular and forms the uphole end of the apparatus 1010 in use (left end as shown in the figures). An upper section 1024 of the top sub 1012 has an inner surface 1026, an outer surface 1028 and an end face 1030 and a lower section 1032 of the top sub 1012 has an inner surface 1034, an outer surface 1036 and end faces 1038, 1040, the end face 1038 disposed on a flange portion 1042 extending from the top sub lower section 1032. An inner shoulder 1044 forms the interface between the inner surfaces 1026, 1034. An outer shoulder 1046 forms the interface between the outer surfaces 1028, 1036. A groove 1048 is formed in the inner surface 1026 and a seal element in the form of o-ring seal 1050 is disposed in the groove 1048. In the illustrated embodiment, the seal 1050 is provided with two seal back-up rings 1052. A groove 1054 is also formed in the outer surface 1036 and a seal element in the form of o-ring seal 1056 is disposed in the groove 1054. In the illustrated embodiment, the seal 1056 is provided with two seal back-up rings 1058.

Figure 15:
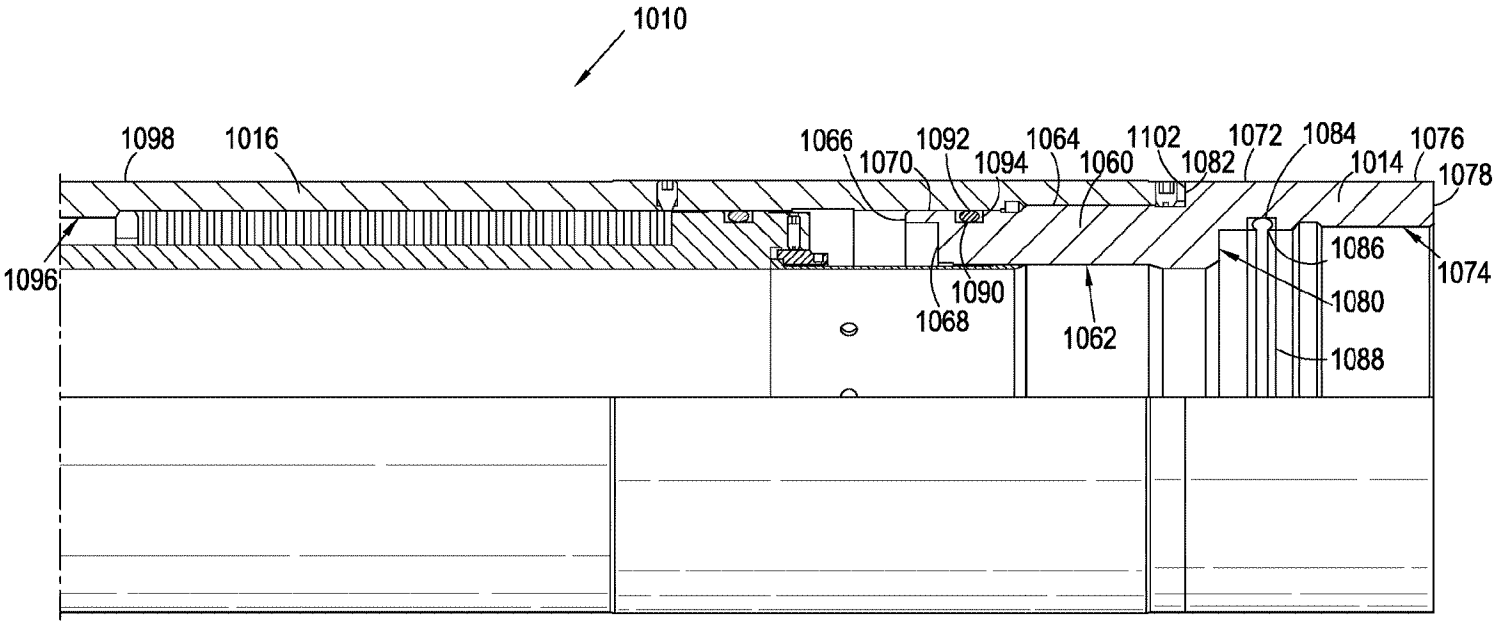
FIG. 15 is an enlarged view of a downhole region of the apparatus shown in FIGS. 13 and 14.

Referring now also to FIG. 15, which shows an enlarged longitudinal cut away view of a lower region of the apparatus 1010 shown in FIGS. 13 and 14, it can be seen that the bottom sub 1014 is generally tubular and forms the downhole end of the apparatus 1010 (right end as shown in the figures and closest to the toe of the well in use). An upper section 1060 of the bottom sub 1014 has an inner surface 1062, an outer surface 1064 and end faces 1066, 1068, the end face 1066 disposed on a flange portion 1070 extending from the bottom sub upper section 1060. A lower section 1072 of the bottom sub 1014 has an inner surface 1074, an outer surface 1076 and an end face 1078. An inner shoulder 1080 forms the interface between the inner surfaces 1062, 1074. An outer shoulder 1082 forms the interface between the outer surfaces 1064, 1076. A groove 1084 is formed in the inner surface 1074 and a seal element in the form of o-ring seal 1086 is disposed in the groove 1084. In the illustrated embodiment, the seal 1086 is provided with two seal back-up rings 1088. A groove 1090 is also formed in the outer surface 1064 and a seal element in the form of o-ring seal 1092 is disposed in the groove 1090. In the illustrated embodiment, the seal 1092 is provided with two seal back-up rings 1094.

In use, the apparatus 1010 is coupled to an adjacent uphole component of string S via the top sub 1012 and to an adjacent downhole component of the sting S via the bottom sub 1014. In the illustrated embodiment, the top sub 1012 and the bottom sub 1014 define threaded box connections, although it will be understood that either or both of the top sub 1012 and the bottom sub 1014 may alternatively define a threaded pin connection or any other suitable connector.

As shown in FIGS. 13, 14 and 15, the outer sleeve 1016 extends between the top sub 1012 and the bottom sub 1014 and is generally tubular in construction, having an inner surface 1096, an outer surface 1098 and end faces 1100, 1102.

On assembly, the apparatus 1010 is configured so that an uphole end region 1104 of the outer sleeve 16 is disposed on the top sub lower section 1032 and secured via thread connection 1106 (as shown most clearly in FIG. 14) while a downhole end region 1108 of the outer sleeve 116 is disposed on the bottom sub upper section 1060 and secured via thread connection 1110 (as shown most clearly in FIG. 15). As can be seen from the figures, the end face 1100 of the outer sleeve 1016 abuts the top sub outer shoulder 1046. The end face 1102 abuts the bottom sub outer shoulder 1082. The sleeve outer surface 1098, the top sub outer surface 1028 and the bottom sub outer surface 1076 define a substantially continuous outer surface of the apparatus 1010. The tubular top sub 1012, inner sleeve 1020 and bottom sub 1014 have a central longitudinal passageway defining a throughbore T'.

As shown most clearly in FIG. 14, the outer sleeve lateral port 1018 extends laterally through the outer sleeve 1016 in a direction perpendicular to the throughbore T'. A silicon plug 1112 is secured in the port 1018 and the remaining volume 1114 of the port 1018 is filled with grease or the like. In addition to the port 1018, a number of lateral bores 1116 are provided in the outer sleeve 1016, the bores 1116 defining or receiving a grease fill port 1118, and, in the illustrated embodiment, four grease fill ports 1118 are provided.

In the illustrated embodiment, the outer sleeve 1016 is a unitary construction, although it will be recognised that in other embodiments the outer sleeve 1016 may be constructed from a number of components secured together. In the illustrated embodiment, the inner sleeve 1020 is constructed from a number of components coupled together, as will be described further below with reference to FIG. 16.

Figure 16:
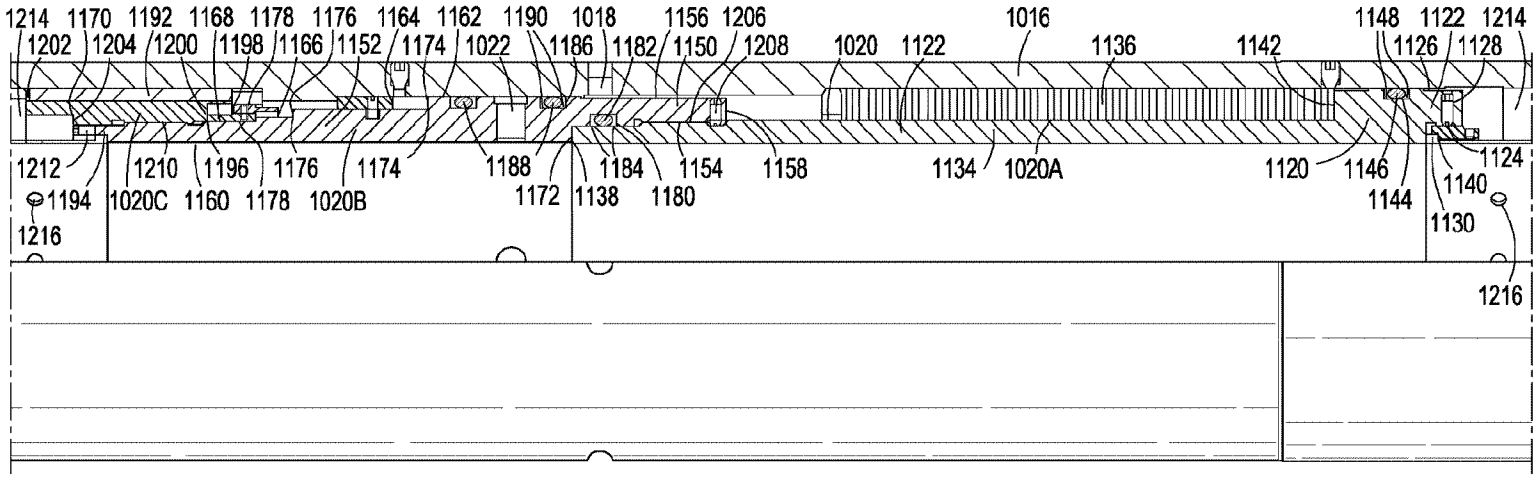
FIG. 16 is an enlarged view of a mid-section of the apparatus shown in FIGS. 13 to 15.

As shown in FIG. 16, the inner sleeve 1020 is generally tubular and is disposed between the top sub 1012 and the bottom sub 1014 and radially inwards of the outer sleeve 1016. In use, the inner sleeve 1020 slides axially relative to the outer sleeve 1016 between the top sub 1012 and bottom sub 1014 to move the apparatus 1010 between the run-in configuration in which the lateral ports 1018, 1022 are not aligned and the activated configuration in which the ports 1018, 1022 are aligned and permit lateral passage of fluid through the apparatus 1010, for example to perform a circulation or well fracturing operation.

The inner sleeve 1020 comprises downhole section 1020*a*, mid-section 1020*b* and uphole section 1020*c*. In the illustrated embodiment, the lateral port 1022 is provided in the mid-section 1020*b*.

The downhole section 1020*a* of inner sleeve 1020 has a lower section 1120 and an upper section 1122. The lower section 1120 has an inner surface 1124, an outer surface 1126 and end faces 1128, 1130, the end face 1128 disposed on a flange portion 1132. The upper section 1122 has an inner surface 1134, an outer surface 1136 and an end face 1138, the upper section 1122 being recessed relative to the lower section 1120 (that is, the upper section 1122 is of reduced outer diameter than the upper section 1120). An inner shoulder 1140 forms the interface between the inner surfaces 1124, 1134. An outer shoulder 1142 forms the interface between the outer surfaces 1126, 1136. A groove 1144 is formed in the outer surface 1126 and a seal element in the form of o-ring seal 1146 is disposed in the groove 1144. In the illustrated embodiment, the seal 1146 is provided with two seal back-up rings 1148.

Mid-section 1020*b* of inner sleeve 1020 has a lower section 1150 and an upper section 1152. The lower section 1150 has an inner surface 1154, an outer surface 1156 and an end face 1158 while the upper section 1152 has an inner surface 1160, a stepped outer surface with steps 1162, 1164, 1166, 1168 and an end face 1170. An inner shoulder 1172 forms the interface between the inner surfaces 1154, 1160. Outer shoulders 1174, 1176, 1178 form the interfaces between the steps 1162, 1164, 1166 1168. A groove 1180 is formed in the inner surface 1154 and a seal element in the form of o-ring seal 1182 is disposed in the groove 1180. In the illustrated embodiment, the seal 1182 is provided with two seal back-up rings 1184. Two grooves 1186 are formed in the outer surface 1156, each groove 1186 having a seal element in the form of an o-ring seal 1188 disposed therein. In the illustrated embodiment, the seals 1188 are each provided with two seal back-up rings 1190. As can be seen from FIG. 16 for example, the seals 1188 straddle the inner sleeve lateral port 1022 and are interposed between the inner sleeve 1020 and the outer sleeve 1016, preventing fluid leakage around the lateral port 1022 in use.

Uphole section 1020*c* of inner sleeve 1020 has an outer surface 1192, a stepped inner surface 1194 having inner shoulder 1196, downhole directed end faces 1198, 1200 and uphole directed end faces 1202, 1204.

As can be seen from FIG. 16, the inner sleeve sections 1020*a*, 1020*b*, 1020*c* are overlapped: the lower section 1150 of mid-section 1020*b* is disposed around the upper section 1122 of the downhole section 1020*a;* the uphole section 1020*c* is disposed around the upper section 1152 of mid-section 1020*b*. The inner sleeve sections 1020*a*, 1020*b*, 1020*c* are also coupled together. The overlapping downhole and mid-sections 1020*a*, 1020*b* are secured by a threaded connection 1206 and one or more grub screw 1208 to restrict relative rotation of the sections 1020*a*, 1020*b*, 1020*c* of the inner sleeve 1020. The overlapping mid and uphole 1020*b*, 1020*c* are secured by a threaded connection 1210 and one or more grub screw 1212. Spaces 1214 between the inner sleeve and the top sub 1012 and bottom sub 1014 are filled with grease or the like, and ports 1216 are provided for the escape of the grease when displaced by the inner sleeve 1020.

Figure 17:
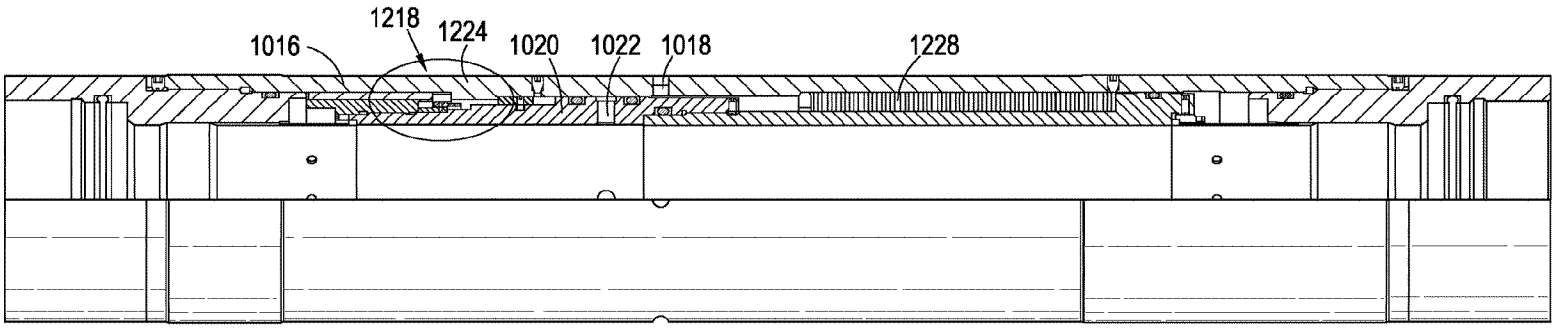
FIG. 17 is an enlarged view of a section of the apparatus shown in FIGS. 13 to 16, shown in the run-in configuration.
Figure 17A:
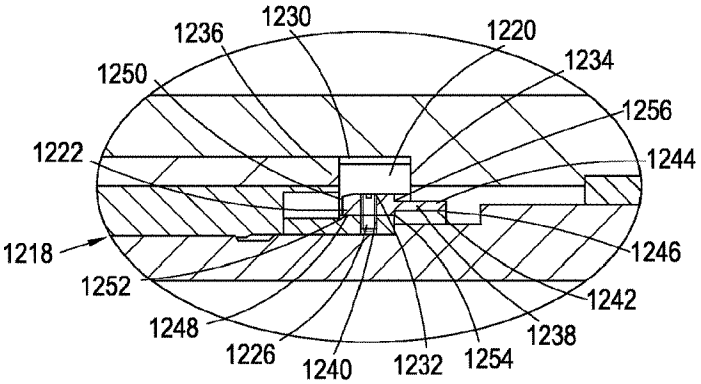
FIG. 17*a* is an enlarged view of the highlighted region of FIG. 17.

Referring now also to FIGS. 17 and 17*a*, there is shown part of an activation apparatus 1218 of the apparatus 1010 according to the illustrated embodiment. The activation apparatus 1218 is disposed between the inner sleeve 1020 and the outer sleeve 1016 and, in use, facilitates movement between the run-in configuration in which the ports 1018, 1022 are not aligned and the activated configuration in which the ports 1018, 1022 are aligned and permit lateral passage of fluid through the apparatus 1010, as will be described further below.

The activation apparatus 1218 comprises an outer snap ring 1220, an inner snap ring 1222, a first stage retainer in the form of first stage shear pin 1224 (see FIG. 17) disposed between the inner sleeve 1020 and the outer sleeve 1016, a second stage retainer in the form of second stage shear pin 1226 disposed between the inner snap ring 1222 and the inner sleeve 1020 and a biasing member in the form of spring 1228, in the illustrated embodiment a flat wire compression spring or Smalley Wave Spring.

The outer snap ring 1220 comprises an annular member having an outer surface 1230, an inner surface 1232, a lower (downhole facing) end face 1234 and an upper (uphole facing) end face 1236.

The inner snap ring 1222 comprises an annular member having a lower section 1238 and an upper section 1240. The lower section 1238 has an inner surface 1242, an outer surface 1244 and an end face 1246. The upper section 1240 has an inner surface 1248, an outer surface 1250 and an end face 1252. An inner shoulder 1254 defines the interface between the inner surfaces 1242, 1248. An outer shoulder 1256 defines the interface between the outer surfaces 1244, 1250. As shown in FIG. 17*a*, second stage shear pin 1126 extends through the inner snap ring 1222 and into the inner sleeve 1020.

Operation of the apparatus 1010 will now be described with reference to all of the figures and in particular with reference to FIGS. 17 to 22*a*.

In operation, the apparatus 1010 is run into the borehole B in the run-in configuration, with the activation apparatus 1218 configured as shown in FIGS. 17 and 17*a*. In this configuration, the outer snap ring 1220 is supported on outer surface 1250 of inner snap ring 1222 and is interposed between the inner sleeve 1020 and the outer sleeve 1016 such that relative axial movement of the inner sleeve 1020 and the outer sleeve 1016 is prevented.

According to the present invention the apparatus 1010 is to be used as a toe sleeve. The toe sleeve is located at a leading end of the completion string S, which may include a variety of other tools such as packers and sliding sleeves (not shown). The completion string S is then run downhole and the toe sleeve positioned as the tool closest to the toe of the well. Pressure is increased within the throughbore T' by an operator at surface. The pressure is increased to 11,000 psi to test the integrity of the completion string S at this high pressure.

Figure 18:
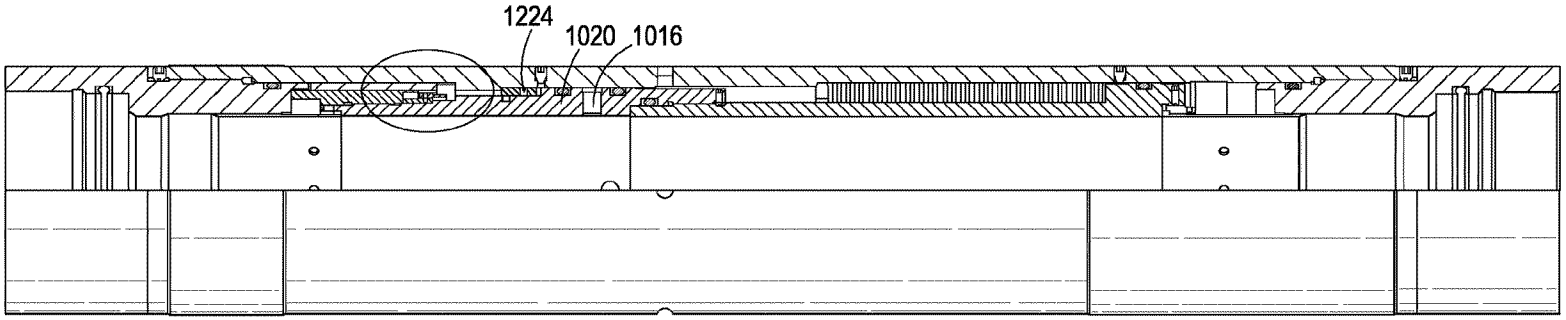
FIG. 18 is an enlarged view of the section of the apparatus shown in FIG. 17, in a second position.
Figure 18A:
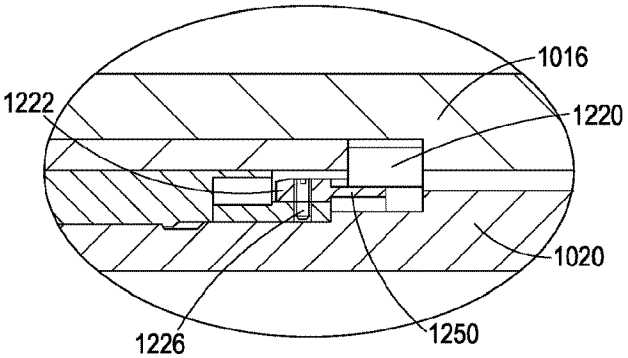
FIG. 18*a* is an enlarged view of the highlighted region of FIG. 18.

This first stage fluid pressure applied within the throughbore T' causes the first stage shear pin 1224 to shear, shifting the inner sleeve 1020 uphole (to the left as shown in the figures) relative to the outer sleeve 1016 from the position shown in FIGS. 17 and 17*a* to the position shown in FIGS. 18 and 18*a*. In this position, the inner snap ring 1222 remains secured to the inner sleeve 1020 via second stage shear pin 1226 and so shifts with the movement of the inner sleeve 1020. As the inner snap ring 1222 shifts uphole, the outer snap ring 1220—which is axially retained by the outer sleeve 1016—is no longer supported by the upper section 1240 of the inner snap ring 1222 and so drops down onto outer surface 1244 of lower section 238 of inner snap ring 1222.

Figure 19:
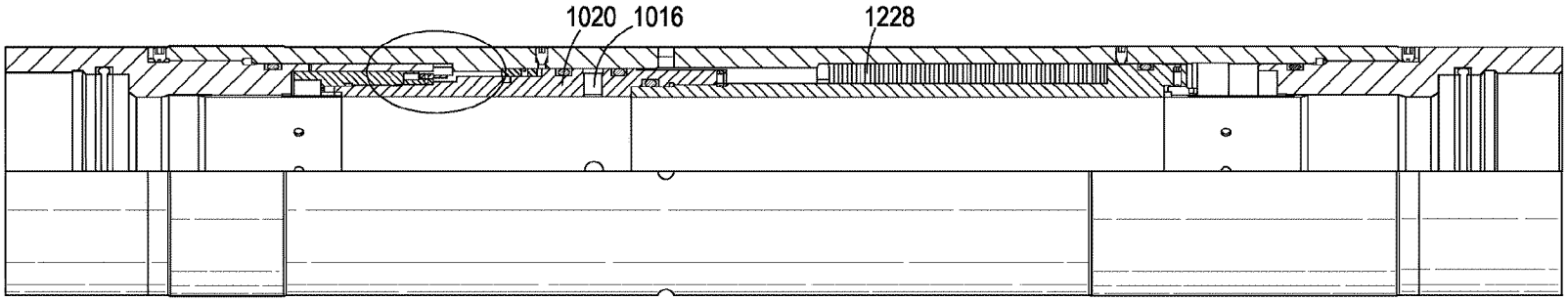
FIG. 19 is an enlarged view of the section of the apparatus shown in FIG. 17, in a third position.
Figure 19A:
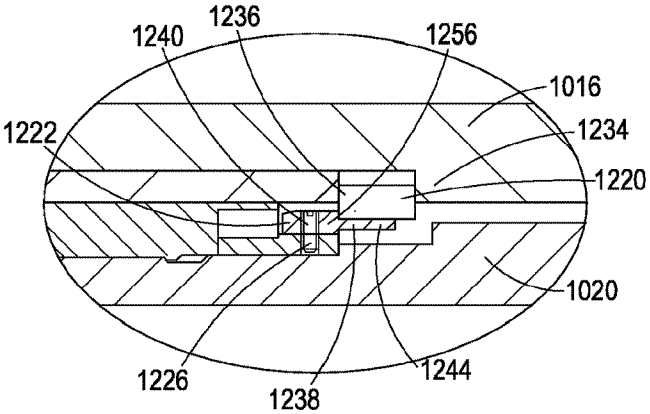
FIG. 19*a* is an enlarged view of the highlighted region of FIG. 19.

When the first stage fluid pressure applied within the throughbore T' is reduced, the spring force applied by the spring 1228 urges the inner sleeve 1020 downhole (to the right as shown in the figures) from the position shown in FIGS. 18 and 18*a* to the position shown in FIGS. 19 and 19*a*. When this occurs, the inner snap ring 1222 is prevented from moving further downhole with the inner sleeve 1020 by virtue of the interlocking engagement between the shoulder 1256 of inner snap ring 1122 and end face 1236 of snap ring 1220 and between end face 1234 of snap ring 1220 and the outer sleeve 1016.

Figure 20:
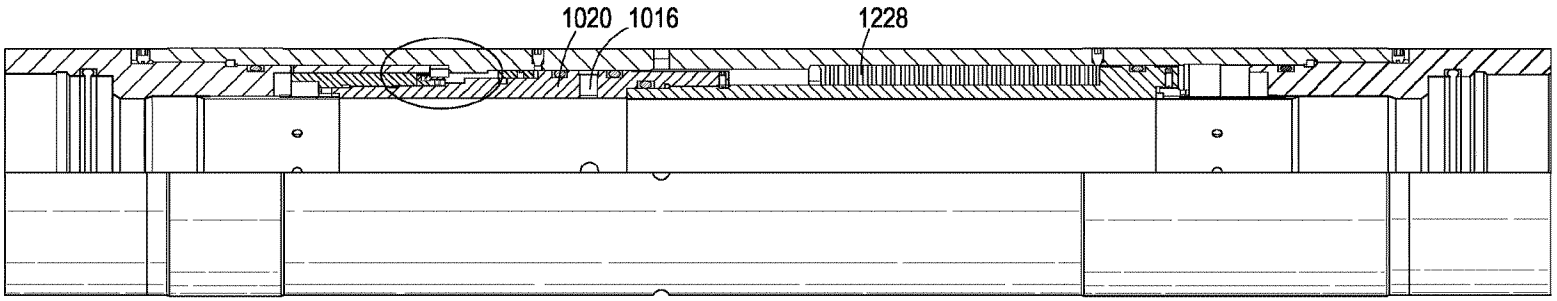
FIG. 20 is an enlarged view of the section of the apparatus shown in FIG. 17, in a fourth position.
Figure 20A:
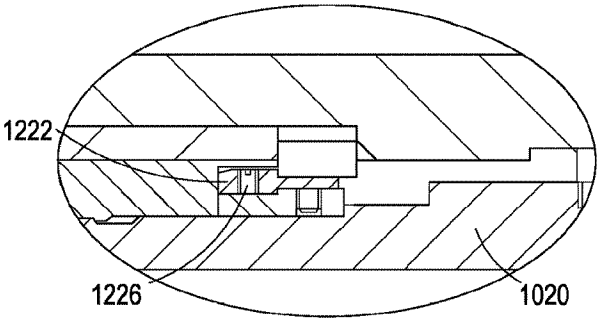
FIG. 20*a* is an enlarged view of the highlighted region of FIG. 20.

The downhole-directed spring force shears the second stage shear pin 1226, and the apparatus 1010 moves from the position shown in FIGS. 19 and 19*a* to the position shown in FIGS. 20 and 20*a*. In this position, since the lower snap ring 1222 is no longer retained by the shear pin 1226, movement of the inner sleeve 1020 in the downhole direction under the influence of the spring force causes the inner snap ring 1222 to drop onto the inner sleeve 1020.

Figure 21:
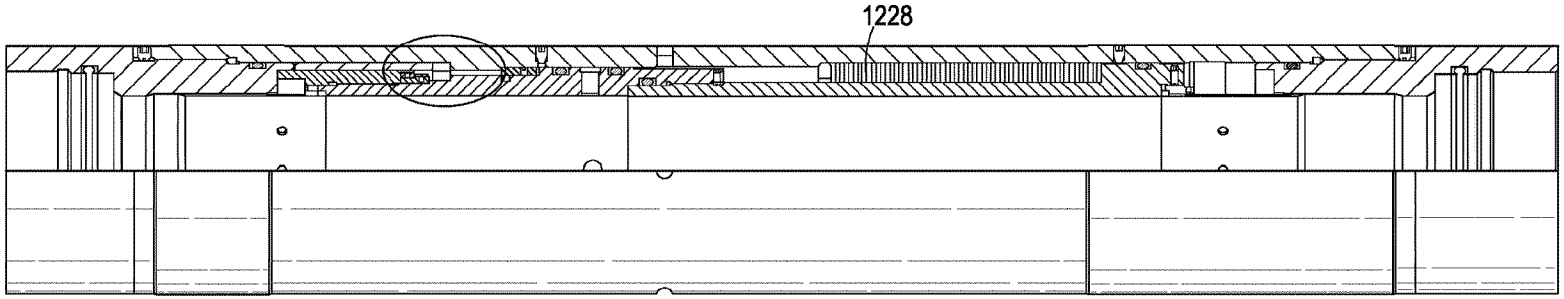
FIG. 21 is an enlarged view of the section of the apparatus shown in FIG. 17, in a fifth position.
Figure 21A:
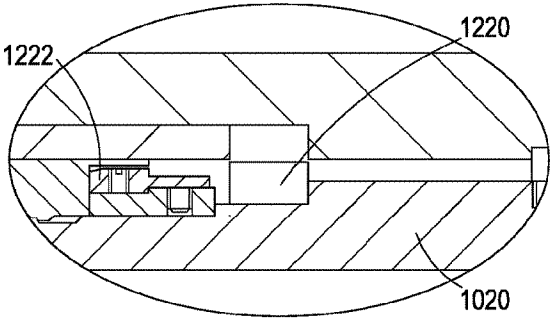
FIG. 21*a* is an enlarged view of the highlighted region of FIG. 21.

A second stage fluid pressure applied within the throughbore T' and acting to cause a pressure differential between the seals 1146, 1188 of the inner sleeve 1020 causes the inner sleeve 1020 to shift uphole from the position shown in FIGS. 20 and 20*a* to the position shown in FIGS. 21 and 21*a*. As can be seen from FIGS. 21 and 21*a*, because the lower snap ring 1222 is seated on the inner sleeve 1020, the lower snap ring 1222 moves uphole with the inner sleeve 1020. As the inner snap ring 1222 shifts uphole, the outer snap ring 1220 is no longer supported by the inner snap ring 1222 and so drops down onto the inner sleeve 1020. In this position, the outer snap ring 1220 is no longer axially restrained by the outer sleeve 1016.

When the second stage fluid pressure is reduced in a controlled manner, the spring force applied by spring 1228 urges the inner sleeve 1020, together with outer snap ring 1220 and inner snap ring 1222, downhole from the position shown in FIGS. 21 and 21*a* to the position shown in FIGS. 22, 22*a* and 23, in which position the apparatus 1010 defines the activated configuration. As can be seen from FIGS. 22, 22*a* and 23, in this position, the ports 1018, 1022 are aligned and fluid passage through the apparatus 1010 is permitted.

Figure 24:
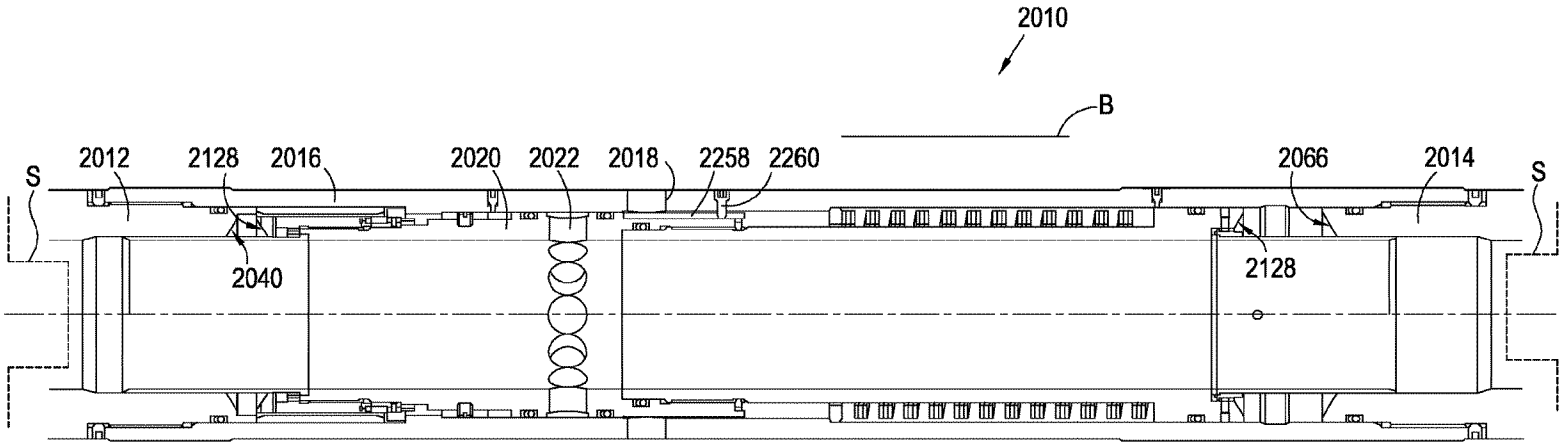
FIG. 24 is a longitudinal section view of an apparatus according to a third embodiment of the present invention.
Figure 25:
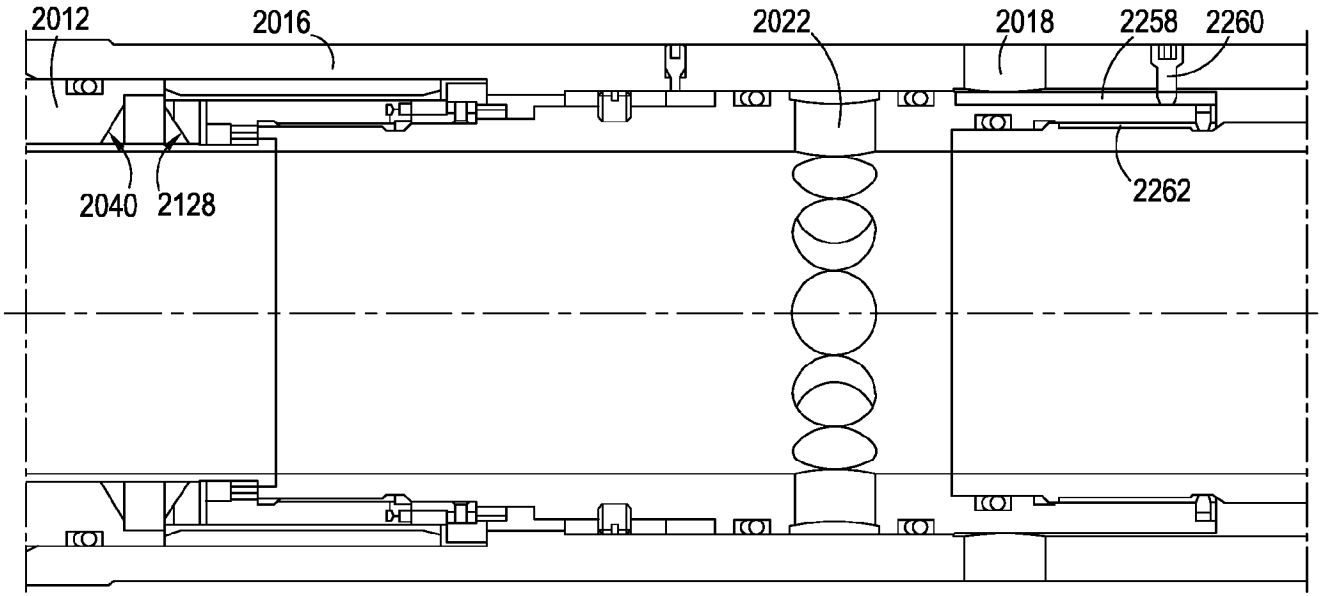
FIG. 25 is an enlarged view of an uphole region of the apparatus shown in FIG. 24.
Figure 26:
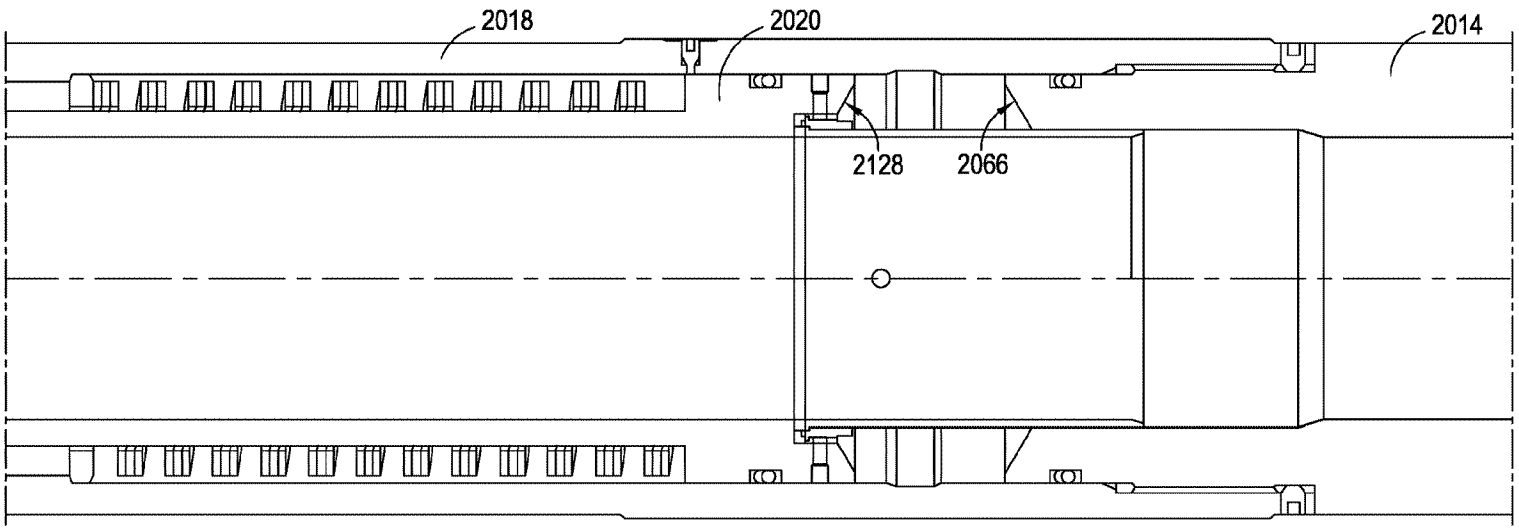
FIG. 26 is an enlarged view of a downhole region of the apparatus shown in FIG. 24.

Referring now to FIGS. 24 to 26, there is shown an apparatus 2010 according to a third embodiment of the present invention. The apparatus 2010 is similar to the apparatus 10 and like components are represented by like numerals incremented by 2000. As in the apparatus 1010, the apparatus 2010 has a top sub 2012, a bottom sub 2014, an outer sleeve 2016 having a port 2018 and an inner sleeve 2020 having a port 2022. The apparatus 2010 takes the form of a toe sleeve which is coupled to and forms part of a completion string (shown diagrammatically by S) which is run into a borehole (shown diagrammatically by B). The apparatus 2010 is configurable between a run-in configuration in which the ports 2018, 2022 are not aligned (as shown in FIG. 13) and an activated position in which the ports 2018, 2022 are aligned and permit lateral passage of fluid through the apparatus 2010 which may be used, for example in well fracturing operations.

In this embodiment, the flow area of port 2018 in outer sleeve 2016 is less than the flow area of port 2022. The apparatus 2010 is thus configured so as to choke flow through the ports 2018, 2020.

In this embodiment, at least one of the ports 2018, 2022 is oval in shape.

In this embodiment, the lower end face 2040 of top sub 2012 and the upper end face 2128 of inner sleeve 2020 are tapered or angled. Similarly, the lower end face 2128 of inner sleeve 2020 and the upper end face 2066 of bottom sub 2014 are tapered or angled. Beneficially, the tapered end faces assist in driving grease from the apparatus 3010 during operation.

In this embodiment, a groove 2258 is formed in the inner sleeve adjacent to the port 2018 in the outer sleeve 2016. One or more retainer 2260 is disposed through the outer sleeve 2016 and into the groove 2258, the retainer 2260 providing rotational alignment between inner sleeve 2020 and the outer sleeve 2016.

A low strength material, in the illustrated embodiment high temperature silicon material 2262, is disposed in the groove 2258. Beneficially, the provision of the low strength material 2262 permits the rotational alignment between the inner and outer sleeves 2016,2020 as described above while also preventing or mitigating escape of grease. The provision of the silicon material 2262 provides a further benefit in that the silicon 2262 retains its position in the groove 2258 and so will not itself escape into the formation or in applications where it may not be desirable to use silicon plugs, such as the silicon plugs 112 described above. Thus, in this embodiment, silicon plugs are not used. However, it will be understood that in other embodiments silicon plugs may be used in addition to the low strength material if desired.

It should be understood that the embodiments described herein are merely exemplary and that various modifications may be made thereto without departing from the scope of the invention.

For example, it will be recognised that the activation apparatus according to the present invention may be used in a variety of tools and applications. By way of example, and referring to FIGS. 27 to 30, there is shown an apparatus 3010 according to a fourth embodiment of the present invention.

Figure 27:
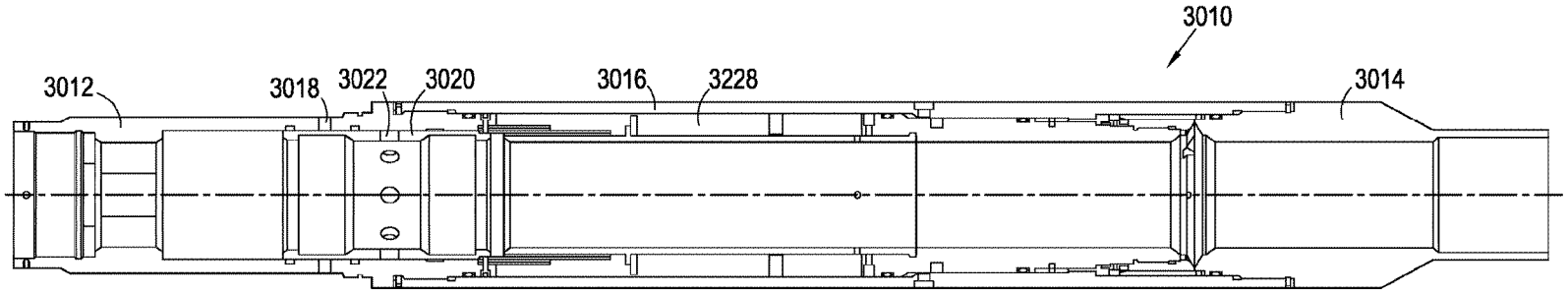
FIG. 27 is a longitudinal section view of an apparatus according to a fourth embodiment of the present invention, shown in a run-in configuration.

As shown in FIG. 27, the apparatus 3010 has a top sub 3012 having a port 3018, a bottom sub 3014, an outer sleeve 3016 and an inner sleeve 3020 having a port 3022.

Figure 30:
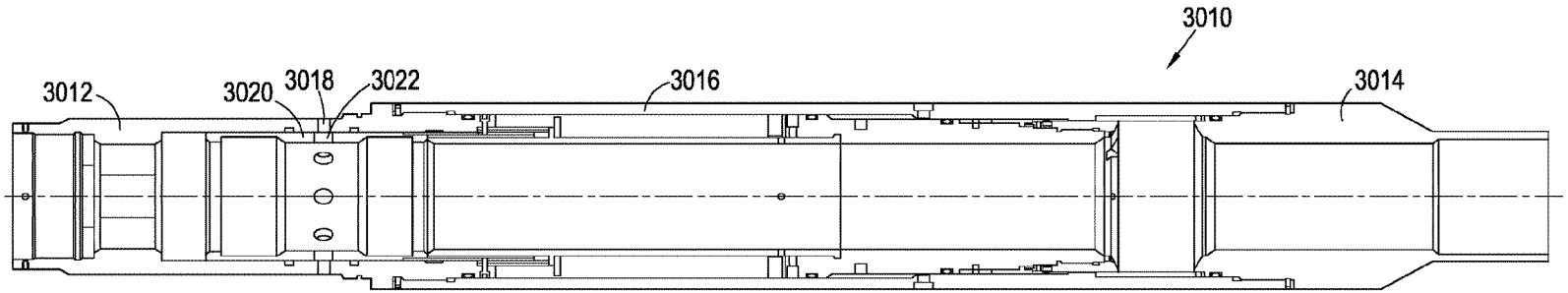
FIG. 30 is a longitudinal cut-away view of the apparatus shown in FIGS. 27 to 29, shown in the activation configuration.
Figure 28:
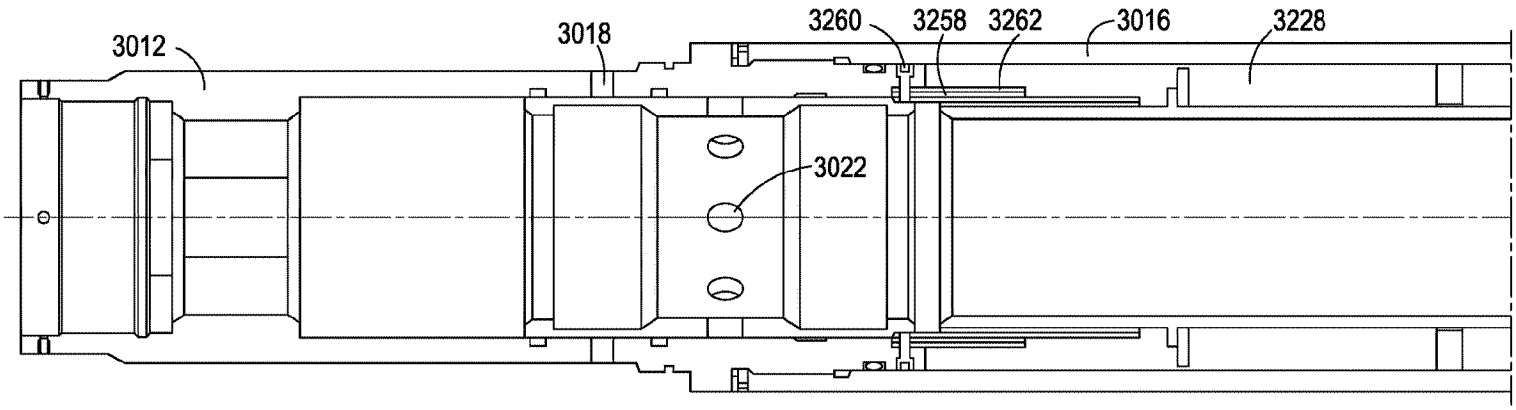
FIG. 28 is an enlarged view of an uphole region of the apparatus shown in FIG. 27.
Figure 29:
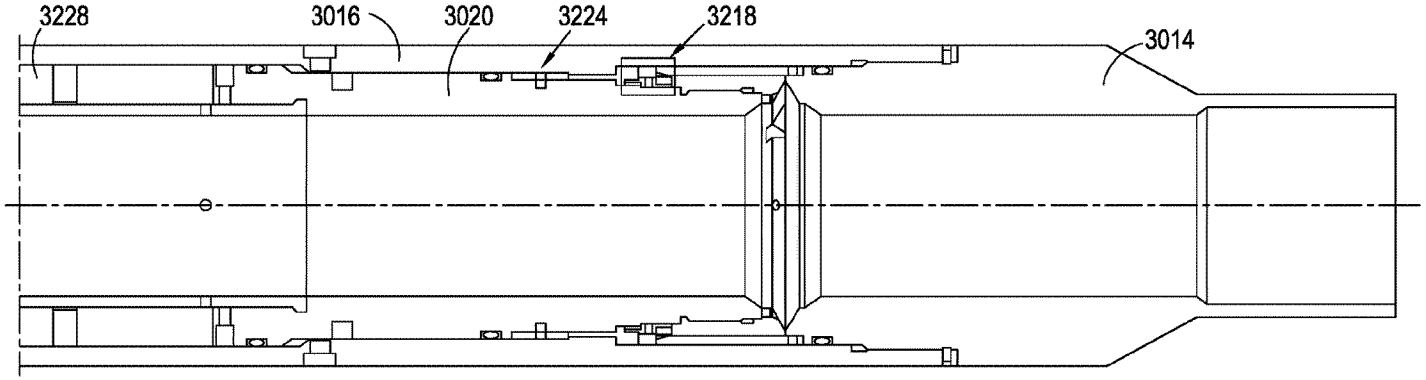
FIG. 29 is an enlarged view of a downhole region of the apparatus shown in FIGS. 27 and 28.
Figure 29A:
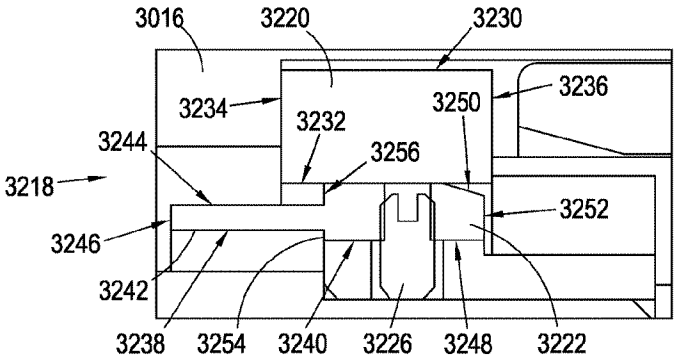
FIG. 29*a* is an enlarged view of the highlighted region of FIG. 29.

In use, the apparatus 3010 is configurable between a run-in configuration in which the ports 3018, 3022 are not aligned (as shown in FIG. 27) and an activated position in which the ports 3018, 3022 are aligned and permit lateral passage of fluid through the apparatus 3010 (as shown in FIG. 30).

The top sub 3012 is generally tubular and forms the uphole end of the apparatus 3010 in use (left end as shown in the figures).

The bottom sub 3014 is generally tubular and forms the downhole end of the apparatus 3010 (right end as shown in the figures).

The outer housing 3016 extends between the top sub 3012 and the bottom sub 3014 and is generally tubular in construction. The inner sleeve 3020 is generally tubular and is disposed between the top sub 3012 and the bottom sub 3014 and radially inwards of the outer housing 3016.

In use, the inner sleeve 3020 slides axially relative to the outer sleeve 3016 between the top sub 3012 and bottom sub 3014 to move the apparatus 3010 between the run-in configuration in which the lateral ports 3018, 3022 are not aligned and the activated configuration in which the ports 3018, 3022 are aligned and permit lateral passage of fluid through the apparatus 3010.

The activation apparatus 3218 is disposed between the inner sleeve 3020 and the outer sleeve 3016 and, in use, facilitates movement between the run-in configuration in which the ports 3018, 3022 are not aligned and the activated configuration in which the ports 3018, 3022 are aligned and permit lateral passage of fluid through the apparatus 3010, as will be described further below.

The activation apparatus 3218 comprises an outer snap ring 3220, an inner snap ring 3222, a first stage retainer in the form of first stage shear pin 3224 disposed between the inner sleeve 3020 and the outer sleeve 3016, a second stage retainer in the form of second stage shear pin 3226 disposed between the inner snap ring 3222 and the inner sleeve 3020 and a biasing member in the form of spring 3228, in the illustrated embodiment a flat wire compression spring or Smalley Wave Spring.

The outer snap ring 3220 comprises an annular member having an outer surface 3230, an inner surface 3232, an upper (uphole facing) end face 3234 and a lower (downhole-facing) end face 3236.

The inner snap ring 3222 comprises an annular member having an upper section 3238 and a lower section 3240. The upper section 3238 has an inner surface 3242, an outer surface 3244 and an end face 3246. The lower section 3240 has an inner surface 3248, an outer surface 3250 and an end face 3252. An inner shoulder 3254 defines the interface between the inner surfaces 3242, 3248. An outer shoulder 3256 defines the interface between the outer surfaces 3244, 3250. Second stage shear pin 3226 extends through the inner snap ring 3222 and into the inner sleeve 3020.

The apparatus 3010 also comprises a groove 3258 and one or more retainer 3260 is disposed through the outer sleeve 3016 and into the groove 3258, the retainer 3260 providing rotational alignment between inner sleeve 3020 and the outer sleeve 3016. A low strength material, in the illustrated embodiment high temperature silicon material 3262, is disposed in the groove 3258.

Operation of the apparatus 3010 will now be described with reference to FIGS. 31 to 35*a*.

Figure 31:
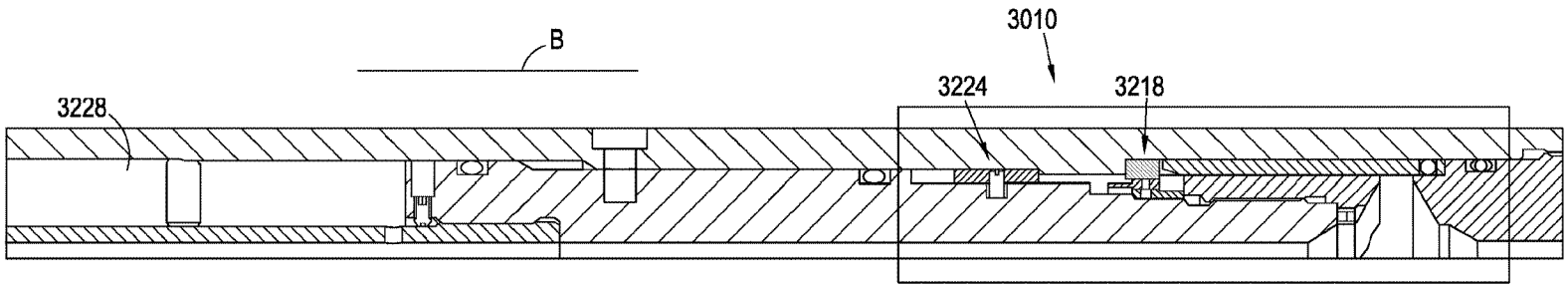
FIG. 31 is an enlarged view of a section of the apparatus shown in FIGS. 27 to 29, shown in the run-in configuration.
Figure 31A:
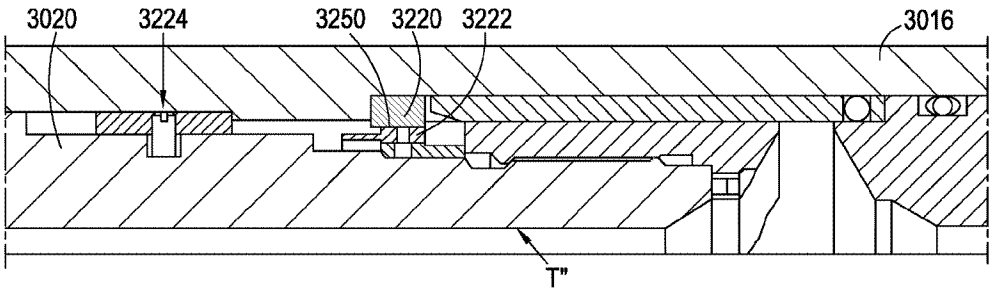
FIG. 31*a* is an enlarged view of the highlighted region of FIG. 31.
Figure 32:
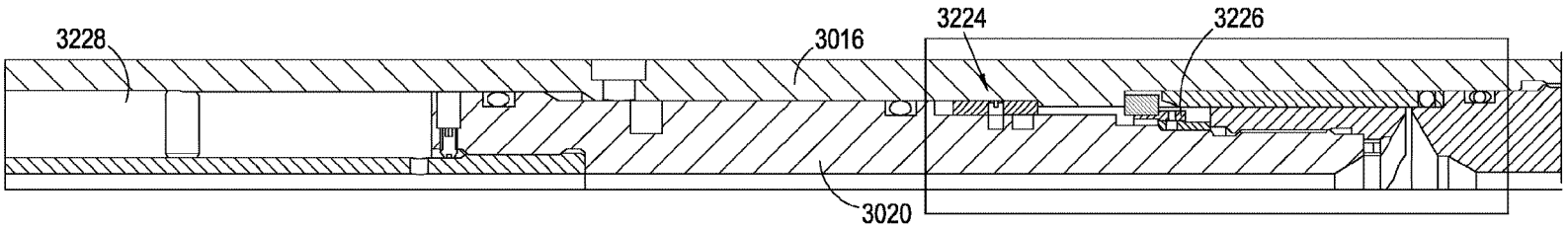
FIG. 32 is an enlarged view of the section of the apparatus shown in FIG. 31 in a second position.
Figure 32A:
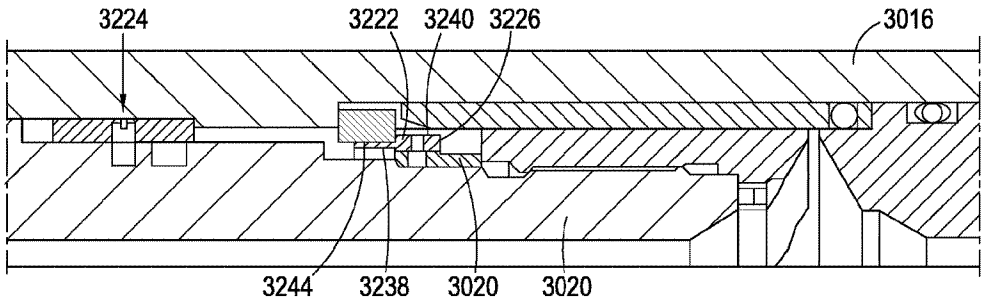
FIG. 32*a* is an enlarged view of the highlighted region of FIG. 32.
Figure 33:
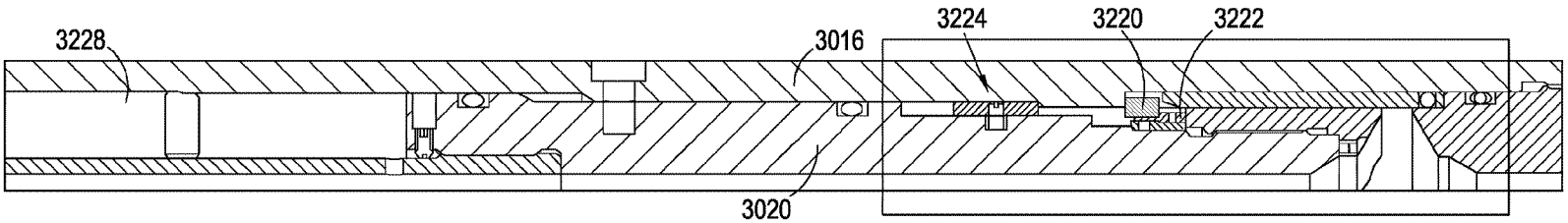
FIG. 33 is an enlarged view of the section of the apparatus shown in FIG. 31, in a third position.
Figure 33A:
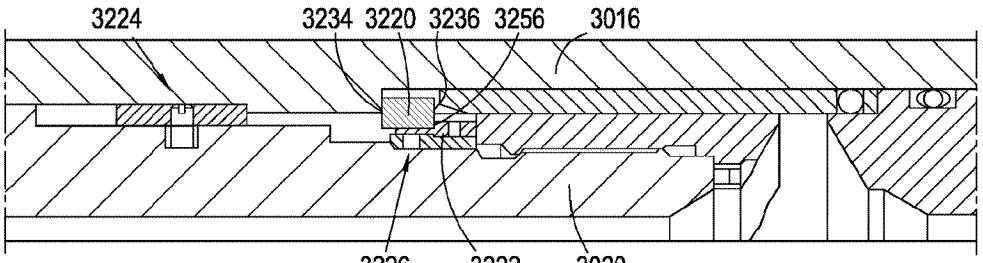
FIG. 33*a* is an enlarged view of the highlighted region of FIG. 33.
Figure 34:
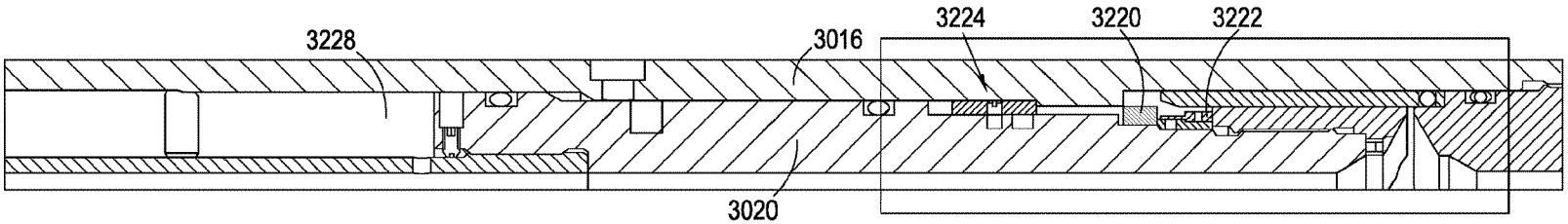
FIG. 34 is an enlarged view of the section of the apparatus shown in FIG. 31, in a fourth position.
Figure 34A:
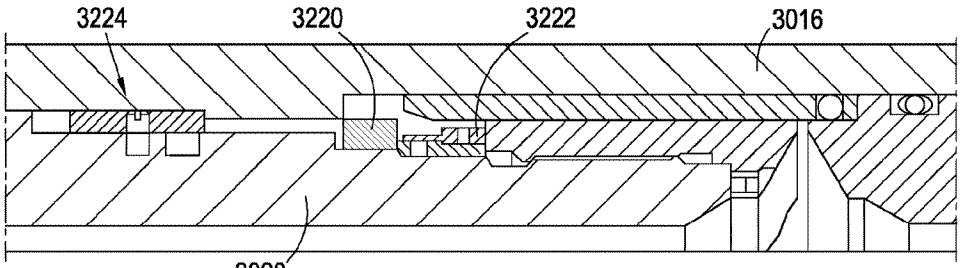
FIG. 34*a* is an enlarged view of the highlighted region of FIG. 34.
Figure 35:
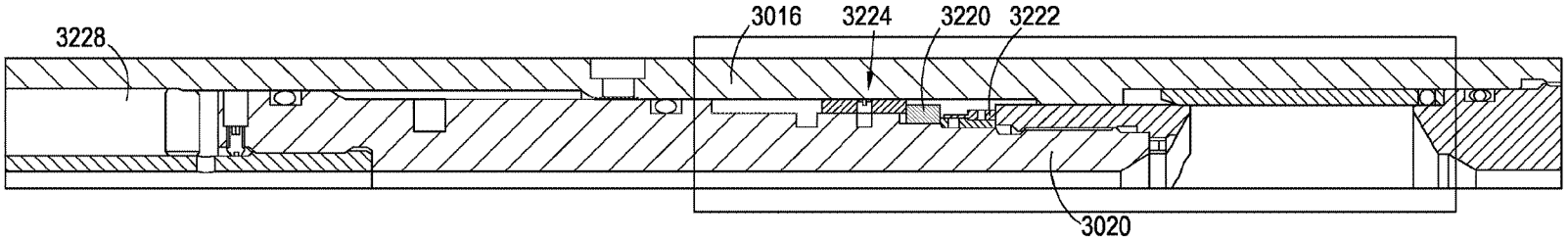
FIG. 35 is an enlarged view of the section of the apparatus shown in FIG. 31, in a fifth position.
Figure 35A:
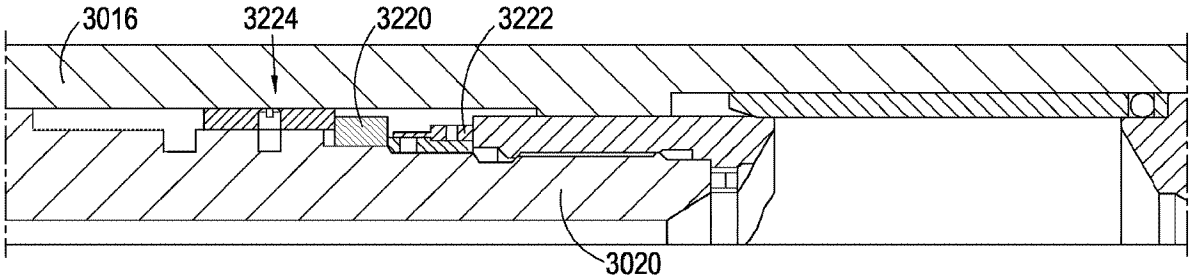
FIG. 35*a* is an enlarged view of the highlighted region of FIG. 35.

In operation, the apparatus 3010 is run into the borehole B in the run-in configuration, with the activation apparatus 3218 configured as shown in FIGS. 31 and 31*a*. In this configuration, the outer snap ring 3220 is supported on outer surface 3250 of inner snap ring 3222 and is interposed between the inner sleeve 3020 and the outer sleeve 3016 such that relative axial movement of the inner sleeve 3020 and the outer sleeve 3016 is prevented.

According to the present invention the apparatus 3010 is to be used as an flow control device or ICD forming part of a completion string S, which may include a variety of other tools such as packers and sliding sleeves (not shown). The completion string S is then run downhole until the apparatus 3010 is positioned at the desired location in the well.

Pressure is increased within the throughbore T" by an operator at surface. This first stage fluid pressure applied within the throughbore T" causes the first stage shear pin 3224 to shear, shifting the inner sleeve 3020 downhole (to the right as shown in the figures) relative to the outer sleeve 3016. The inner snap ring 3222 remains secured to the inner sleeve 3020 via second stage shear pin 3226 and so shifts with the movement of the inner sleeve 3020. As the inner snap ring 3222 shifts downhole, the outer snap ring 3220—which is axially retained by the outer sleeve 3016—is no longer supported by the lower section 3240 of the inner snap ring 3222 and so drops down onto outer surface 3244 of upper section 3238 of inner snap ring 3222.

When the first stage fluid pressure applied within the throughbore T" is reduced, the spring force applied by the spring 3228 urges the inner sleeve 3020 uphole (to the left as shown in the figures). When this occurs, the inner snap ring 3222 is prevented from moving further uphole with the inner sleeve 3020 by virtue of the interlocking engagement between the shoulder 3256 of inner snap ring 3222 and end face 3236 of upper snap ring 3220 and between end face 3234 of upper snap ring 3220 and the outer sleeve 3016.

The uphole-directed spring force shears the second stage shear pin 3226. Since the lower snap ring 3222 is no longer retained by the shear pin 3226, movement of the inner sleeve 3020 in the uphole direction under the influence of the spring force causes the inner snap ring 3222 to drop onto the inner sleeve 3020.

A second stage fluid pressure applied within the throughbore T" causes the inner sleeve 3020 to shift downhole. Because the lower snap ring 3222 is seated on the inner sleeve 3020, the lower snap ring 3222 moves downhole with the inner sleeve 3020. As the inner snap ring 3222 shifts downhole, the outer snap ring 3220 is no longer supported by the inner snap ring 3222 and so drops down onto the inner sleeve 3020. In this position, the outer snap ring 3220 is no longer axially restrained by the outer sleeve 3016.

When the second stage fluid pressure is reduced in a controlled manner, the spring force applied by spring 3228 urges the inner sleeve 3020, together with outer snap ring 3220 and inner snap ring 3222, uphole in which position the apparatus 3010 defines the activated configuration. In this position, the ports 3018, 3022 are aligned and fluid passage through the apparatus 3010 is permitted.

A number of other modifications are described below.

For example, while the illustrated embodiment describes a two stage activation, the activation apparatus may comprise more than three configurations. In such embodiments, at least one further activation apparatus may be provided in series with a first activation apparatus. For example, movement permitted by a first set of snap rings may uncover a port permitting communication with a second activation apparatus. Beneficially, this may permit further intermediate pressure cycles without activating the tool but that do not also increase the wall thickness of the tool.

The downhole tool may comprise a profile on its inner surface to permit application of forces to the activation apparatus using a mechanical shift tool or the like.

Faces of the tool, for example end faces or steps, may be angled to push any grease/cement debris out of the way when the moving parts of the tool are activated.

Where a plurality of ports are provided, these may be disposed radially around the tool or at different axial locations along the tool.

The first activation member, for example first snap ring, may be disposed in a groove in the outer sleeve or in a bore extending through the outer sleeve, the bore having a cap. The provision of a capped bore beneficially permits exterior access into the activation apparatus where desired or required, for example for assembly or disassembly.

The invention claimed is:

1. An activation apparatus for activating a downhole tool, the activation apparatus comprising:

a first, outer, activation member and a second, inner, activation member, the first activation member and the second activation member forming at least part of a lock of the activation apparatus, the first activation member configurable from a first, larger, dimension configuration to at least one smaller dimension configuration to unlock the activation apparatus, wherein the activation apparatus is configured such that application of at least two transition forces to the activation apparatus transitions the activation apparatus from a first configuration to a second configuration, wherein the activation apparatus comprises a third configuration, the third configuration comprising a primed or intermediate configuration, wherein the second activation member supports the first activation member in the first configuration and in the primed or intermediate configuration, and wherein the second activation member is axially moveable to de-support the first activation member to permit the activation apparatus to be transitioned to the second configuration.

2. The activation apparatus of claim 1, wherein the at least two transition forces are applied by a force application arrangement.

3. The activation apparatus of claim 2, wherein at least one of:

the force application arrangement comprises a mechanical force applicator;

the force application arrangement comprises a mechanical force applicator, the mechanical force applicator comprising a biasing member;

the force application arrangement comprises a mechanical force applicator, the mechanical force applicator comprising a spring;

the force application arrangement comprises a fluid pressure arrangement;

the force application arrangement comprises a fluid pressure arrangement, the fluid pressure arrangement comprising an applied fluid pressure; and the force application arrangement comprises a fluid pressure arrangement, the fluid pressure arrangement comprising a differential pressure.

4. The activation apparatus of claim 1, wherein the first activation member comprises an outer snap ring.

5. The activation apparatus of claim 1, wherein the second activation member comprises an inner snap ring.

6. The activation apparatus of claim 1, wherein one of:

the activation apparatus comprises a first stage retainer; and the activation apparatus comprises a first stage retainer, the first stage retainer comprising a shear pin.

7. The activation apparatus of claim 1, wherein one of:

the activation apparatus comprises a second stage retainer; and the activation apparatus comprises a second stage retainer, the second stage retainer comprising a shear pin.

8. A system, comprising:

a downhole tool; and an activation apparatus according to claim 1.

9. The system of claim 8, wherein the activation apparatus is integral to or forms part of the downhole tool.

10. The system of claim 8, wherein the downhole tool comprises an axial flow passage.

11. The system of claim 8, wherein the downhole tool comprises a lateral flow passage.

12. The system of claim 11, wherein at least one of:

in the first configuration, the downhole tool is configured to prevent lateral passage of fluid through the downhole tool;

in the primed configuration, the downhole tool is configured to prevent lateral passage of fluid through the downhole tool; and in the second configuration, the downhole tool is configured to permit lateral passage of fluid through the downhole tool.

13. The system of claim 8, wherein the downhole tool comprises a first member and a second member operatively associated with the first member, wherein at least one of the first member and the second member is configured to move relative to the other of the first member and the second member.

14. The system of claim 13, wherein the first member comprises an inner sleeve and the second member comprises an outer sleeve.

15. The system of claim 8, wherein the downhole tool comprises a rotational lock.

16. The system of claim 15, wherein the rotational lock comprises a retainer configured to engage a groove.

17. The system of claim 15, wherein an insert is disposed in the rotational lock, the insert comprising at least one of a low strength solid material and a silicon material.

18. The activation apparatus of claim 1, wherein at least one of:

the activation apparatus is configured to be unlocked from the first configuration by application of a first initiation force to permit the activation apparatus to be transitioned from the first configuration to the primed or intermediate configuration by a first of the at least two transition forces, and the activation apparatus is configured to be unlocked from the primed or intermediate configuration by application of a second initiation force to permit the activation apparatus to be transitioned from the primed or intermediate configuration to the second configuration by a second of the at least two transition forces.

19. The activation apparatus of claim 18, wherein the initiation forces configure the activation apparatus to permit transitioning by the at least two transition forces, the at least two initiation forces applied by an initiation force application arrangement.

20. The activation apparatus of claim 19, wherein at least one of:

the initiation force application arrangement comprises a fluid pressure arrangement;

the initiation force application arrangement comprises a fluid pressure arrangement, the initiation force application arrangement comprising an applied fluid pressure;

the initiation force application arrangement comprises a fluid pressure arrangement, the initiation force application arrangement comprising an applied fluid pressure in the range of 5000 psi to 18000 psi;

the initiation force application arrangement comprises a fluid pressure arrangement, a first of the at least two initiation forces resulting from a first applied pressure and a second of the at least two initiation forces resulting from a second applied pressure;

the initiation force application arrangement comprises a fluid pressure arrangement, a first of the at least two initiation forces resulting from a first applied pressure and a second of the at least two initiation forces results from a second applied pressure, the first applied pressure in the range 10000 psi to 18000 psi;

the initiation force application arrangement comprises a fluid pressure arrangement, a first of the at least two initiation forces resulting from a first applied pressure and a second of the at least two initiation forces results from a second applied pressure, the second applied pressure in the range 5000 to 15000 psi; and the initiation force application arrangement comprises at least one mechanical initiation force applicator.

21. The activation apparatus of claim 19, wherein at least one of the initiation forces comprises a force equal to or exceeding a force at which a downhole tool is activated.

22. A method for activating a downhole tool, comprising:

providing an activation apparatus comprising a first, outer, activation member and a second, inner, activation member, the first activation member and the second activation member forming at least part of a lock of the activation apparatus, the first activation member configurable from a first, larger, dimension configuration to at least one smaller dimension configuration to unlock the activation apparatus, wherein the second activation member supports the first activation member in a first configuration and in a primed or intermediate configuration, and wherein the second activation member is axially moveable to de-support the first activation member to permit the activation apparatus to be transitioned to a second configuration; and applying at least two transition forces to the activation apparatus to transition the activation apparatus from the first configuration to the second configuration via a third configuration,the third configuration comprising the primed or intermediate configuration.

23. The method of claim 22, comprising at least one of:

running the activation apparatus downhole locked in the first configuration;

unlocking the activation apparatus from the first configuration by applying a first initiation force to the activation apparatus to permit the activation apparatus to be transitioned from the first configuration to the primed or intermediate configuration by a first of the at least two transition forces;

unlocking the activation apparatus from the primed or intermediate configuration by applying a second initiation force to the activation apparatus to permit the activation apparatus to be transitioned from the primed or intermediate configuration to the second configuration by a second of the at least two transition forces;

unlocking the activation apparatus from the first configuration simultaneously with, or as a result of, increasing pressure in a throughbore of a downhole tool;

using a force applicator within the downhole tool to apply the first transition force to the activation apparatus to transition the activation apparatus from the first configuration to the primed configuration;

locking the activation apparatus in the primed configuration simultaneously with, or as a result of, reducing pressure in the throughbore of the downhole tool;

unlocking the activation apparatus from the primed configuration to transition the activation apparatus from the primed configuration to another intermediate configuration or the second configuration;

unlocking the activation apparatus from the primed configuration simultaneously with, or as a result of, increasing the pressure in the throughbore of the downhole tool; and using a force applicator within the downhole tool to apply the second transition force to the activation apparatus to transition the activation apparatus from the primed configuration to the second configuration.

* * * * *